US007646369B2

(12) United States Patent
Kobashi et al.

(10) Patent No.: US 7,646,369 B2
(45) Date of Patent: Jan. 12, 2010

(54) METHOD OF DRIVING LIQUID CRYSTAL DISPLAY DEVICE, LIQUID CRYSTAL DISPLAY DEVICE,AND ELECTRONIC APPARATUS

(75) Inventors: Yutaka Kobashi, Mizuho (JP); Takashi Toya, Gifu (JP)

(73) Assignee: Epson Imaging Devices Corporation, Azumino (JP)

( * ) Notice: Subject to any disclaimer, the term of this patent is extended or adjusted under 35 U.S.C. 154(b) by 688 days.

(21) Appl. No.: 11/354,120

(22) Filed: Feb. 15, 2006

(65) Prior Publication Data

US 2006/0232538 A1 Oct. 19, 2006

(30) Foreign Application Priority Data

Mar. 30, 2005 (JP) ..... 2005-100085

(51) Int. Cl.
*G09G 3/36* (2006.01)

(52) U.S. Cl. ..... 345/87; 345/98; 345/100; 345/204

(58) Field of Classification Search ..... 345/87, 345/204, 98, 208, 100
See application file for complete search history.

(56) References Cited

U.S. PATENT DOCUMENTS

| | | | | |
|---|---|---|---|---|
| 6,496,174 | B2 * | 12/2002 | Kurumisawa et al. | 345/98 |
| 2002/0000964 | A1 * | 1/2002 | Sumiya | 345/87 |
| 2002/0015031 | A1 * | 2/2002 | Fujita et al. | 345/204 |
| 2002/0030528 | A1 * | 3/2002 | Matsumoto et al. | 327/331 |
| 2002/0080109 | A1 * | 6/2002 | Nagata et al. | 345/92 |
| 2002/0180717 | A1 * | 12/2002 | Ishiyama | 345/204 |
| 2002/0180720 | A1 * | 12/2002 | Ishiyama | 345/208 |
| 2003/0080934 | A1 * | 5/2003 | Ishiyama | 345/100 |
| 2004/0246216 | A1 * | 12/2004 | Hosaka | 345/87 |
| 2005/0253829 | A1 * | 11/2005 | Mamba et al. | 345/204 |
| 2008/0297676 | A1 * | 12/2008 | Kimura | 349/39 |
| 2009/0002586 | A1 * | 1/2009 | Kimura | 349/39 |

FOREIGN PATENT DOCUMENTS

| | | | |
|---|---|---|---|
| JP | A 62-49399 | | 3/1987 |
| JP | 09243997 | A * | 9/1997 |
| JP | A 11-142815 | | 5/1999 |
| JP | B2 2982877 | | 9/1999 |
| JP | A 2005-70539 | | 3/2005 |
| JP | A 2005-70540 | | 3/2005 |
| JP | A 2005-70541 | | 3/2005 |

* cited by examiner

*Primary Examiner*—Amare Mengistu
*Assistant Examiner*—Premal Patel
(74) *Attorney, Agent, or Firm*—Oliff & Berridge, PLC

(57) ABSTRACT

A method of driving a liquid crystal display device includes a plurality of scanning lines, a plurality of data lines arranged to intersect the plurality of scanning lines, a plurality of pixel electrodes arranged in correspondence with the intersections between the plurality of scanning lines and the plurality of data lines, a plurality of pixel switching elements for supplying the signals of the data lines to the pixel electrodes based on the signals of the scanning lines, and an opposed electrode facing the pixel electrodes. The plurality of scanning lines are supplied with respective timings to apply any one of a selection potential and a non-selection potential to the pixel switching elements, the opposed electrode is inversion-driven between a first potential and a second potential, and at least one of the plurality of scanning lines has the selection potential at a common inversion timing when the opposed electrode is inverted from the first potential to the second potential.

13 Claims, 18 Drawing Sheets

FIG. 9

| | R | G | B | R | G | B | R | G | B |
|---|---|---|---|---|---|---|---|---|---|
| SCANNING LINE 1 13-1 | +3.98 | -4.00 | +3.98 | -4.00 | +3.98 | -4.00 | -4.00 | +3.98 | -4.00 |
| SCANNING LINE 2 13-2 | -3.98 | +4.00 | -3.98 | +4.00 | -3.98 | +4.00 | +4.00 | -3.98 | +4.00 |
| SCANNING LINE 3 13-3 | +3.98 | -4.00 | +3.98 | -4.00 | +3.98 | -4.00 | -4.00 | +3.98 | -4.00 |
| | | | | | | | | | |
| SCANNING LINE 480 13-480 | -3.98 | +4.00 | -3.98 | +4.00 | -3.98 | +4.00 | +4.00 | -3.98 | +4.00 |
| | DATA LINE 1 15-1 | DATA LINE 2 15-2 | DATA LINE 3 15-3 | DATA LINE 4 15-4 | DATA LINE 5 15-5 | DATA LINE 6 15-6 | DATA LINE 1918 15-1918 | DATA LINE 1919 15-1919 | DATA LINE 1920 15-1920 |

FIG. 11

| | R | G | B | R | G | B | R | G | B |
|---|---|---|---|---|---|---|---|---|---|
| | DATA LINE 1 | DATA LINE 2 | DATA LINE 3 | DATA LINE 4 | DATA LINE 5 | DATA LINE 6 | DATA LINE 1918 | DATA LINE 1919 | DATA LINE 1920 |
| SCANNING LINE 1 | +4.00 | +4.00 | +4.00 | +4.00 | +4.00 | +4.00 | +4.00 | +4.00 | +4.00 |
| SCANNING LINE 2 | -4.00 | -4.00 | -4.00 | -4.00 | -4.00 | -4.00 | -4.00 | -4.00 | -4.00 |
| SCANNING LINE 3 | +4.00 | +4.00 | +4.00 | +4.00 | +4.00 | +4.00 | +4.00 | +4.00 | +4.00 |
| SCANNING LINE 480 | -4.00 | -4.00 | -4.00 | -4.00 | -4.00 | -4.00 | -4.00 | -4.00 | -4.00 |

FIG. 16

| | R | G | B | R | G | B | R | G | B |
|---|---|---|---|---|---|---|---|---|---|
| SCANNING LINE 1 13-1 | +3.98 | +3.98 | +3.98 | -4.00 | -4.00 | -4.00 | +3.98 | +3.98 | +3.98 |
| SCANNING LINE 2 13-2 | -3.98 | -3.98 | -3.98 | +4.00 | +4.00 | +4.00 | -3.98 | -3.98 | -3.98 |
| SCANNING LINE 3 13-3 | +3.98 | +3.98 | +3.98 | -4.00 | -4.00 | -4.00 | +3.98 | +3.98 | +3.98 |
| | | | | | | | | | |
| SCANNING LINE 480 13-480 | -3.98 | -3.98 | -3.98 | +4.00 | +4.00 | +4.00 | -3.98 | -3.98 | -3.98 |
| | DATA LINE 1 15-1 | DATA LINE 2 15-2 | DATA LINE 3 15-3 | DATA LINE 4 15-4 | DATA LINE 5 15-5 | DATA LINE 6 15-6 | DATA LINE 1918 15-1918 | DATA LINE 1919 15-1919 | DATA LINE 1920 15-1920 |

METHOD OF DRIVING LIQUID CRYSTAL DISPLAY DEVICE, LIQUID CRYSTAL DISPLAY DEVICE,AND ELECTRONIC APPARATUS

BACKGROUND

1. Technical Field

The invention relates to a method driving a liquid crystal display device, and more particularly, to a method of inversion-driving a common electrode of a liquid crystal display device using an active matrix substrates.

2. Related Art

Recently, for a notebook type personal computer or a monitor, a liquid crystal display device employing an active matrix circuit using active elements such as a thin film transistor (TFT) has be rapidly popularized.

In a general liquid crystal display device using a nematic phase liquid crystal material, the liquid crystal material is controlled by a potential difference between a pixel electrode which is switched by active elements sandwiching the liquid crystal materials therebetween and a common electrode, and thus the display states of the pixels are controlled. When the potential difference between the pixel electrode and the common electrode is large, that is, at the time of black display in a normally white mode or at the time of white display in a normally black mode, a maximum potential difference between the common electrode and the pixel electrode is generally 3 V to 5 V, although it varies depending on the used liquid crystal material, a liquid crystal mode, and a liquid crystal gap. In the liquid crystal display device, in order to ensure reliability of the liquid crystal element, current drive for inverting the polarity of a voltage applied to the liquid crystal in a given time is required, and, if the potential of the common electrode is fixed, a potential signal written to the pixel electrode, that is, a potential amplitude of an image signal input to a data line of an active matrix circuit, becomes 6 V to 10 V.

When the image signal input to the data line is written by an external data driver IC, in order to output the potential amplitude of at least 5 V, an expensive IC manufactured by a high-breakdown-voltage process must be used instead of a general MOS process. Accordingly, the manufacturing cost increases and power consumption increases. Thus, a driving method of using a common inversion drive for inversion-driving a common electrode every polarity to reduce the amplitude of the signal input to a data line was suggested (See JP-A-62-49399).

In polarity inversion, there are a field inversion drive, a gate inversion drive, a source inversion drive, and a dot inversion drive. These drive methods are for setting the polarity of the common electrode of the pixels at any timing, and flicker becomes gradually less visible in the order of the field inversion drive, the gate inversion drive or the source inversion drive, and the dot inversion drive. Accordingly, in the gate inversion drive or the source inversion drive, and more particularly, the dot inversion drive, display quality is improved and it is difficult to generate flicker. Thus, it is possible to reduce a frame frequency and thus to easily realize low-power-consumption driving.

However, when common inversion drive is performed, since a constant relaxation time is required in common inversion, the polarity inversion can be performed in only one scanning period or one field period and thus it is impossible to perform the source inversion drive or the dot inversion drive. In order to solve the problem, in JP-A-11-142815, a method of patterning a common electrode and separately driving the common electrodes was suggested. However, since the common electrode is not patterned in general or is patterned using a patterning technology having low precision, in order to manufacture the common electrode in a shape suggested in JP-A-11-142815, an additional photolithographic process is required and thus the manufacturing cost thereof increases. Furthermore, in the display having high definition, the assembling precision of a pixel array and a color filter substrate is disadvantageous and thus it is difficult to realize this method. Moreover, in Japanese Patent No. 2982877, a method of alternately and symmetrically inverting the pixels with respect to the gate line so that the gate inversion drive appears to be the dot inversion drive was suggested. However, in this method, when displaying characters or straight line data, since the line on the same scanning line is displayed in a zigzag shape, display quality is deteriorated. In order to solve this problem, an IC for processing an external image signal is required and thus the manufacturing cost thereof increases.

SUMMARY

An advantage of some aspect of the invention is that it prevents the increase of cost or the deterioration of image quality when simultaneously realizing a common inversion drive and a dot inversion drive.

According to an aspect of the invention, provided is a method of driving a liquid crystal display device comprising a plurality of scanning lines, a plurality of data lines arranged to intersect the plurality of scanning lines, a plurality of pixel electrodes arranged in correspondence with the intersections between the plurality of scanning lines and the plurality of data lines, a plurality of pixel switching elements for supplying the signals of the data lines to the pixel electrodes based on the signals of the scanning lines, and an opposed electrode facing the pixel electrodes. The plurality of scanning lines are supplied with respective timings to apply any one of a selection potential and a non-selection potential to the pixel switching elements, the opposed electrode is inversion-driven between a first potential and a second potential, and at least one of the plurality of scanning lines has the selection potential at a common inversion timing when the opposed electrode is inverted from the first potential to the second potential. By this method, since an image signal having a different polarity can be written even in one scanning-line selection period, it is possible to realize a driving method by which flicker becomes more invisible, compared with gate inversion drive such as dot inversion drive.

Furthermore, in the method of driving the liquid crystal display device, at the common inversion timing, the data lines may be in a high electrical impedance state with a signal terminal for supplying an image signal or a precharge signal and may be in a floating state except the pixel electrodes. By this driving method, when the common inversion is performed during the selection of the scanning line, since the potential of the data line is also inverted by the capacitive coupling, the potential between the data line and the common electrode does not vary before and after the common inversion and thus a desired image can be obtained.

Moreover, in the method of driving the liquid crystal display device, the non-selection potential supplied to the scanning lines may be inversion-driven between a third potential and a fourth potential, a scanning-line inversion timing when the non-selection potential of the scanning lines is inversion-driven from the third potential to the fourth potential may be substantially identical to the common inversion timing, and a difference between the third potential and the fourth potential may be substantially identical to a difference between the first potential and the second potential. Alternatively, the scanning lines may be in a high electrical impedance state with a power supply line for supplying the selection potential and a power supply line for supplying the non-selection potential in the common inversion timing. By this driving method, the potential difference between the data line and the common electrode can be prevented from being reduced before and after the common inversion by capacitive division with the gate line.

In addition, in the method of driving the liquid crystal display device, a scanning-line selection period that one of the plurality of scanning lines may have the selection potential has a first selection period that an image signal is written to a first data line of the plurality of data lines, a second selection period that the image signal is written to a second data line of the plurality of data lines, a first non-selection period that the image signal is not written to all the plurality of data lines, and a second non-selection period that the image signal is not written to all the plurality of data lines, the common inversion period may be in the first non-selection period, the first selection period may be before the first non-selection period, the second selection period may be after the first non-selection period, and the length of the first non-selection period may be longer than that of the second non-selection period. By this driving method, since the data line is in a floating state during the relaxation time of the common inversion, the potential difference between the data line and the common electrode can be prevented from being reduced before and after the common inversion and the writing time is not reduced.

Furthermore, in the method of driving the liquid crystal display device, the potential amplitude of the image signal written to the data lines in the first selection period may be greater than that of the image signal written to the data lines in the second selection period. By this configuration, it is possible to compensate the potential of the data line even when the potential of the data line written before the common inversion varies by the capacitive division.

In addition, according to another aspect of the invention, provided is a liquid crystal display device using the method. By the above-described driving method, it is possible to realize the liquid crystal display device of the common inversion drive, by which the flicker becomes more invisible, compared with a gate inversion method and to realize a liquid crystal display device having low cost, high image quality, and low power consumption.

Moreover, in the liquid crystal display device, when the number of the scanning lines is n, a capacitance between the data line and the scanning line is C1, a capacitance between the data line and the opposed electrode is C2, and a capacitance between the data line and the pixel electrode and a capacitance with the data line except the capacitances C1 and C2 is C3, $(C1/n+C3)/(C1+C2+C3) \leqq 0.005$ may be satisfied. In this liquid crystal display device, the variation in the potential difference between the data line and the common electrode before and after the common inversion is less than 1/64 gradation, the flicker becomes invisible and thus an unevenness failure is not generated although the driving method of the invention is used.

In addition, in the liquid crystal display device, when the amplitude of the image signal written to the data line in the first selection period is $\Delta V1$ and the amplitude of the image signal written to the data line in the second selection period is $\Delta V2$, $\Delta V1$ may be substantially identical to $\Delta V2*\{1+2*(C1/n+C3)/(C1+C2+C3)\}$. In this liquid crystal display device, although the variation in the potential difference between the data line and the common electrode before and after the common inversion is generated, the variation is compensated by the image signal.

Furthermore, in the liquid crystal display device, a first pixel electrode of the plurality of pixel electrodes connected to the first data line and a second pixel electrode of the plurality of pixel electrodes connected to the second data line may be connected to the same scanning line, and may be pixels corresponding to the same color display. By this configuration, since the polarities of the same color pixels on the same scanning line are opposite to each other, the flicker becomes more invisible compared with the gate inversion driving method, even at the time of a single color display.

Moreover, in the liquid crystal display device, the first pixel electrode and the second pixel electrode may be closest to each other in the pixels corresponding to the same color display and connected to the same scanning line. By this configuration, since the polarities of the adjacent same-color pixels on the same scanning line are opposite to each other, the flicker becomes more invisible.

In addition, in the liquid crystal display device, a data-line driving circuit may be formed on the same substrate as that of an active matrix circuit. In this liquid crystal display device, a parasitic capacitance at the outside of the active matrix circuit of the data line at the time of the common inversion is reduced and thus the variation in the potential difference between the data line and the common electrode before and after the common inversion is reduced. Thus, this liquid crystal display device is suitable for the driving method of the invention.

Moreover, according to a further aspect of the invention, provided is an electronic apparatus using the above-described liquid crystal display device of the invention. By this configuration, since a cheap driver having a breakdown voltage can be used as an external IC, the cost can be reduced and the flicker can become invisible. Accordingly, since the liquid crystal display device having high image quality and low power consumption can be used as a display, it is possible to realize the electronic apparatus having low cost, high image quality, and a long battery driving time. The electronic apparatus includes a monitor, a TV, a notebook type personal computer, a personal digital assistant (PDA), a digital camera, a video camera, a portable phone, a portable photo viewer, a portable video player, a portable DVD player, and a portable audio player.

BRIEF DESCRIPTION OF THE DRAWINGS

The invention will be described with reference to the accompanying drawings, wherein like numbers reference like elements.

FIG. 9 illustrates voltages applied to the liquid crystal elements of the pixels according to the first embodiment of the invention.

FIG. 11 illustrates voltages applied to the liquid crystal elements of the pixels according to the comparative embodiment.

FIG. 16 illustrates voltages applied to the liquid crystal elements of the pixels according to the modified example of the second embodiment.

DESCRIPTION OF EXEMPLARY EMBODIMENTS

Hereinafter, embodiments of the invention will be described.

First Embodiment

Figure 1:
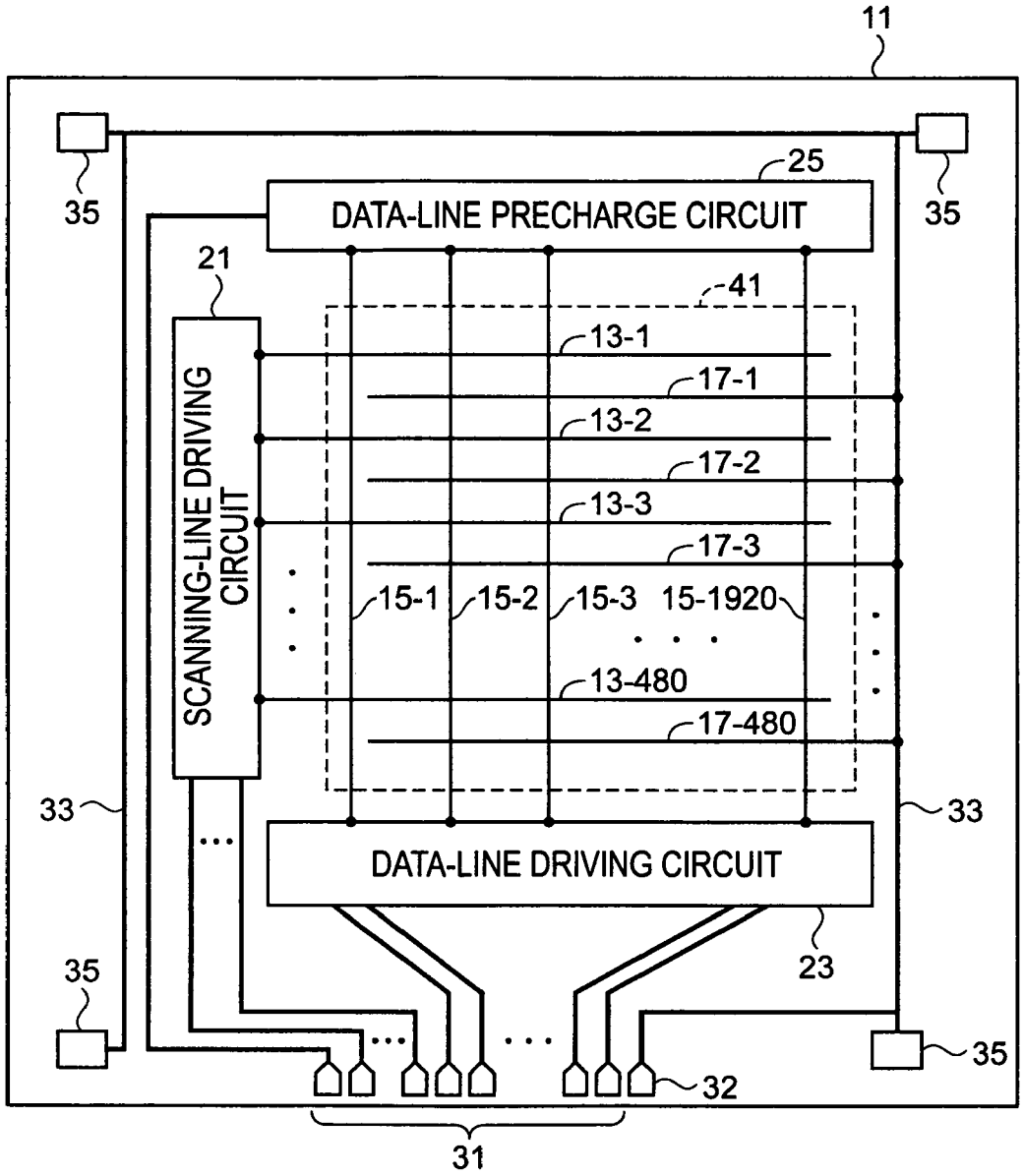
FIG. 1 illustrates a configuration of an active matrix substrate according to a first embodiment of the invention.

FIG. 1 illustrates a configuration of an active matrix substrate 11 for a transmissive liquid crystal display device having VGA resolution, according to a first embodiment of the invention. On the active matrix substrate 11, 480 scanning lines 13 and 1920 data lines 15 are formed to intersect to each other, and 480 capacitive lines 17 are alternately arranged in parallel to the scanning lines 13 such that the scanning lines 13 and the capacitive lines 17 form pairs.

In addition, the scanning lines 13 are connected to a scanning-line driving circuit 21, which is connected to a plurality of signal input terminals 31. A signal for applying various signals and a power supply potential is supplied from the signal input terminals 31 to the scanning-line driving circuit 21. Moreover, the end of the data line 15 at the side of the signal input terminal 31 is connected with a data-line driving circuit 23, and the other end of the data line 15 is connected with a data-line precharge circuit 25. The data-line driving circuit 23 and the data-line precharge circuit 25 are connected with the signal input terminals 31. Moreover, a signal for applying various signals and a power supply potential is supplied from the signal input terminals 31 to the data-line driving circuit 23 and the data-line precharge circuit 25.

The capacitive lines 17 are short-circuited to each other and connected to a common potential input terminal 32, to which a common potential signal is supplied, through a common potential line 33. The common potential line 33 is arranged in the edges of the active matrix substrate 11 and connected with a vertical conductive portion 35 which is connected to an opposed electrode of an opposed substrate in the corners thereof.

Figure 2:
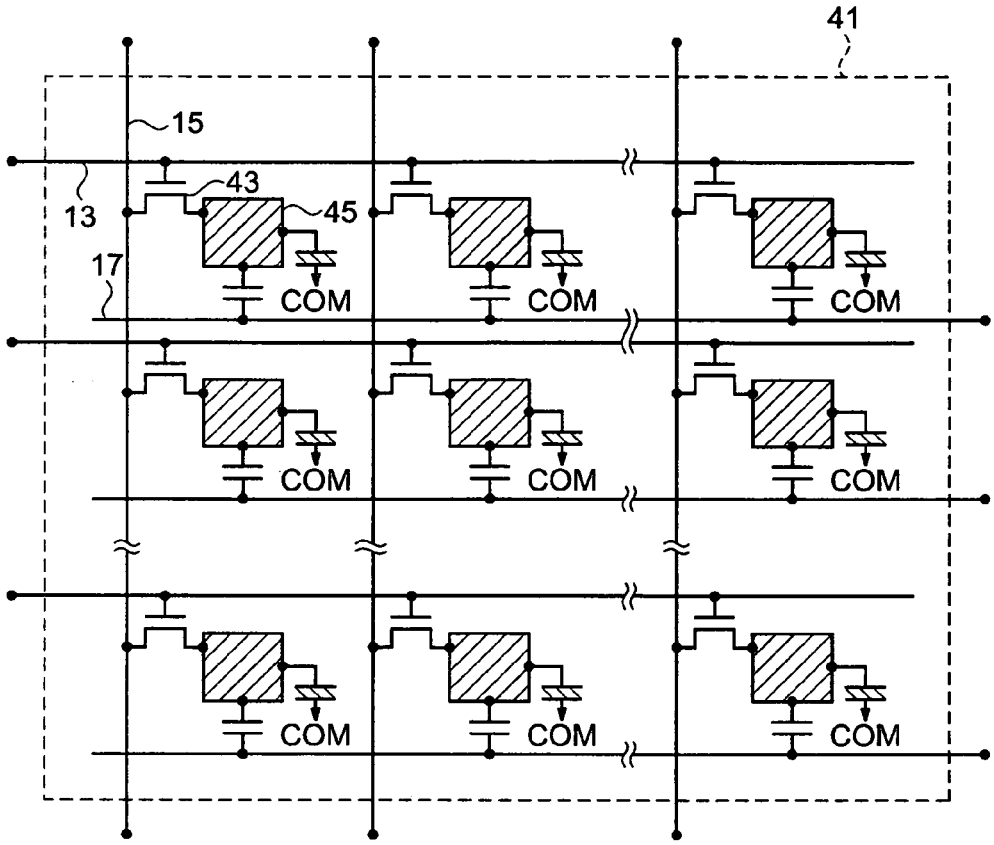
FIG. 2 is a circuit diagram of pixels of the active matrix substrate according to the first embodiment of the invention.

FIG. 2 is a circuit diagram of pixels formed in a display region 41 of the active matrix substrate 11. Pixel switching elements 43 composed of N-channel type field effect polysilicon thin film transistor are formed in intersections between the scanning lines 13 and the data lines 15, of which the gate electrodes are connected to the scanning lines 13, the source electrodes are connected to the data lines 15, and the drain electrodes are connected to pixel electrodes 45. The pixel electrodes 45 and the opposed electrode (common electrode) of the opposed substrate through the liquid crystal material therebetween form liquid crystal capacitors, and the pixel electrodes and the capacitive lines 17 form auxiliary capacitors.

Figure 3:
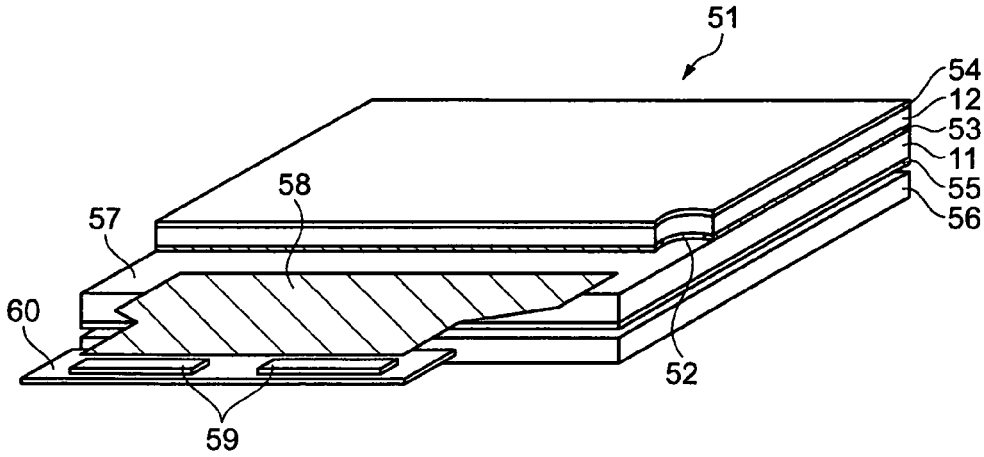
FIG. 3 is a perspective view of a liquid crystal display device according to the first embodiment of the invention.

FIG. 3 is a perspective view (partial cross-sectional view) of the transmissive liquid crystal display device having VGA resolution according to the first embodiment. In a liquid crystal display device 51, a nematic phase liquid crystal material 52 is sandwiched between the active matrix substrate 11 and the opposed substrate 12, and the both substrates 11 and 12 are adhered to each other by a sealing material 53. Although not illustrated, an alignment material composed of polyimide, etc. is coated on the pixel electrodes of the active matrix substrate 11 and is subjected to a rubbing process such that an alignment layer is formed. Although not illustrated, on the opposed substrate 12, color filters which are formed in correspondence with the pixels and the opposed electrode which is composed of indium-tin-oxide (ITO) and provided with a common potential are formed. In addition, an alignment material composed of polyimide, etc. is coated on the surface of the opposed substrate 12, which contacts the liquid crystal material 52, and is subjected to a rubbing process in a direction perpendicular to the rubbing direction of the alignment layer of the active matrix substrate 11.

In addition, an upper polarization plate 54 is placed at the outside of the opposed substrate 12 and a lower polarization plate 55 is placed at the outside of the active matrix substrate 11 such that the polarization directions thereof are perpendicular to each other (cross nicol shape). Furthermore, a backlight unit 56, which is a surface light source, is placed below the lower polarization plate 55. As the backlight unit 56, a cathode ray tube or a LED having a light guide plate or a scatter plate, or a unit which emits light by an electroluminescence element may be used. Although not illustrated, if necessary, the peripheral thereof may be covered with an outer envelope or a protective glass or acrylic plate may be attached on the upper polarization plate 54. In addition, in order to improve viewing angle, an optical compensating film may be attached.

Furthermore, in the active matrix substrate 11, a protrusion 57 protruded from the opposed substrate 12 is provided, on which a plurality of mounted terminals (not illustrated) are provided. The plurality of mounted terminals are electrically connected to a circuit board 60, on which an external driving circuit IC 59 is mounted, through a FPC (flexible board) 58. In FIG. 3, although the external driving circuit IC 59 is composed of two ICs, the number thereof may be one or three.

In the first embodiment, the display is performed in a normally white mode. When a potential difference between the common electrode and the pixel electrode is 4 V, the liquid crystal display device is in a complete opaque state (black display), and, when the potential difference is 0 V, the liquid crystal display device is in a complete transmission state (white display). A reflective or semi-transmissive liquid crystal display device may be used, instead of the transmissive liquid crystal display device.

Figure 4:
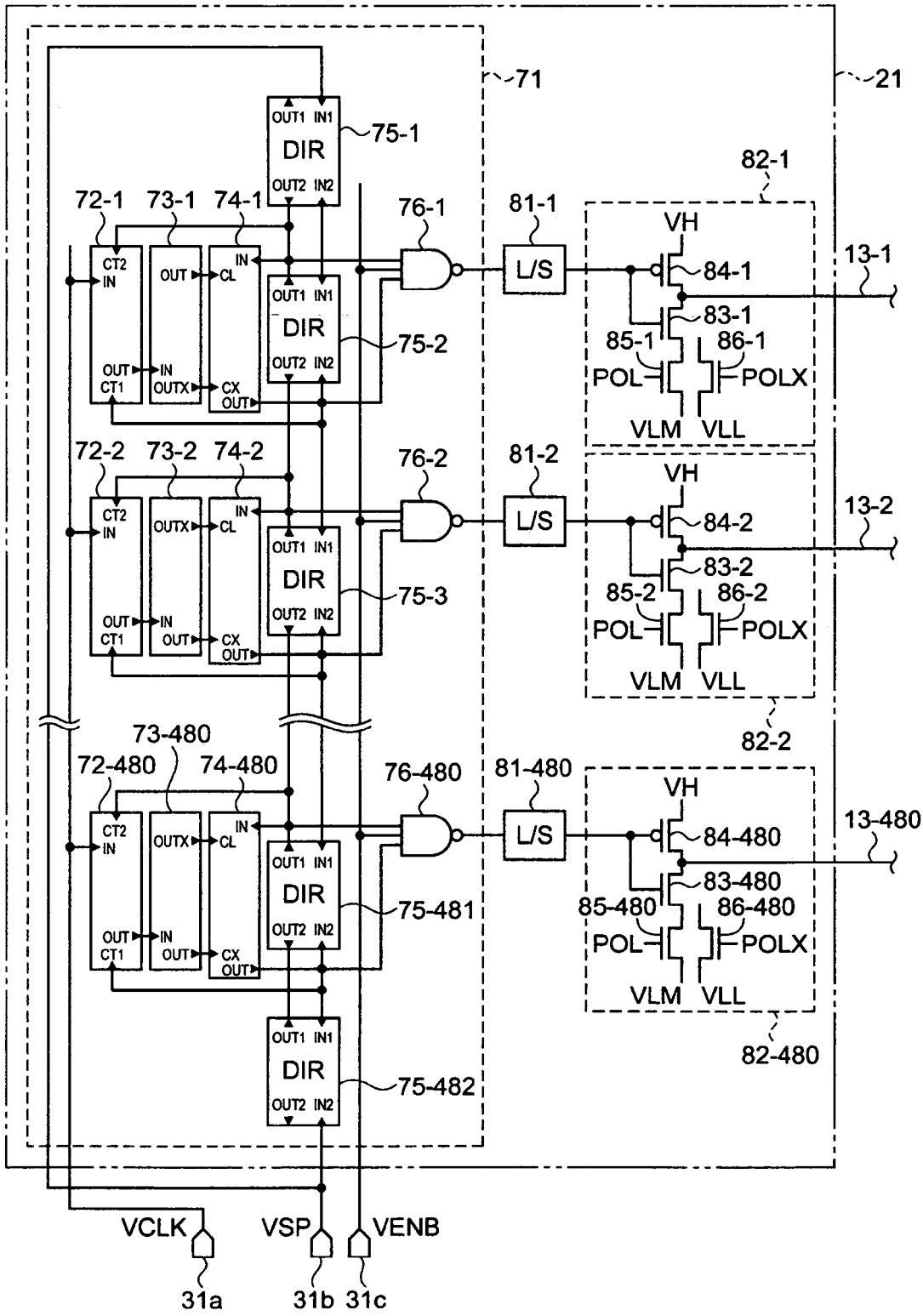
FIG. 4 is a circuit diagram of a scanning-line driving circuit according to the first embodiment of the invention.

FIG. 4 illustrates a configuration of the scanning-line driving circuit 21 according to the first embodiment, and FIG. 5 illustrates configurations of the components therein.

The scanning-line driving circuit 21 includes a sequentially selecting circuit 71, a level shifter circuit 81 connected to the output terminal of the sequentially selecting circuit 71, and an output circuit 82 connected to the output terminal of the level shifter circuit 81 and the scanning lines 13.

A dotted line 71 of FIG. 4 denotes the sequentially selecting circuit using a bidirectional shift register and is driven with a voltage level VD-VS. Here, VD=8 V and VS=0 V.

The sequential selecting circuit 71 includes a clock control circuit (CCC) 72 as a unit-circuit, a clock generating circuit 73, and a latch circuit 74, and a bidirectional transmission circuit 75, and a NAND circuit 76.

Figure 5A:
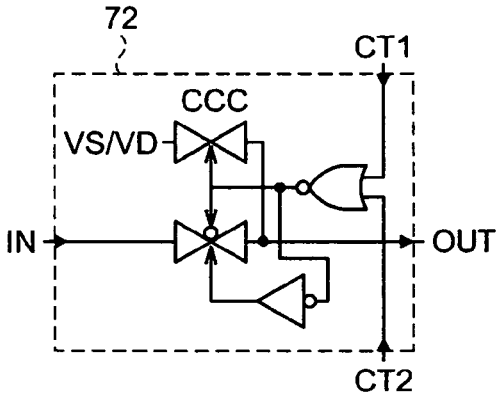
FIG. 5 is a circuit diagram of components in the scanning-line driving circuit according to the first embodiment of the invention.

The clock control circuit 72, as illustrated in FIGS. 4 and 5A, receives a clock signal VCLK from a clock signal terminal 31*a* and supplies the clock signal to the clock generating circuit 73 based on signals CT1 and CT2 of the bidirectional transmission circuit 75. That is, the clock control circuit 72 transmits the clock signal when any one of the signal CT1 and CT2 is high and blocks the clock signal and outputs the fixed potential level VS or VD when the both signals CT1 and CT2 are low. Accordingly, only a desired stage is supplied with the clock signal and the other stages are not supplied with the clock signal and thus the load of the clock signal VCLK can be reduced. In the first embodiment, the stages of n=odd use VS and the stages of n=even use VD. By this configuration, since the clock signal is supplied to only the stages to which the signal is transmitted, the capacitance of the clock signal line 77 is reduced, the malfunction due to delay is prevented, and current consumption is reduced. In addition, the clock control circuit 72 may be omitted when the load of the clock signal line 77 is not disadvantageous.

Figure 5B:
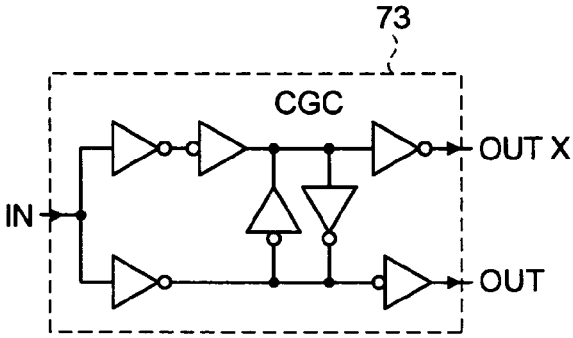

Next, the clock generating circuit 73, as illustrated in FIGS. 4 and 5B, receives the unipolar clock signal VCLK output from the clock control circuit 72, and generates and outputs a bipolar clock signal without phase shift to the latch circuit 74. By this configuration, it is possible to prevent the malfunction of the latch circuit 74 due to the phase shift between the output bipolar clock signals. Moreover, when the phase shift of the clock signal is not disadvantageous, the clock generating circuit 73 may be omitted by inputting a reverse polarity signal of the clock signal VLCK.

Figure 5C:
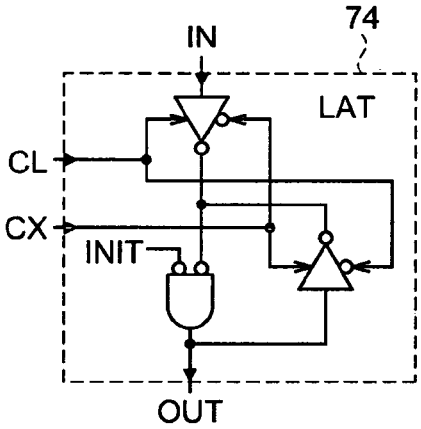

The latch circuit 74, as illustrated in FIGS. 4 and 5C, latches or sequentially transmits a start pulse signal VSP input from a start pulse signal terminal 31*b* by the clock signal generated at the clock generating circuit 73 from the clock signal VCLK. That is, the latch circuit 74 transmits the start pulse signal VSP when the clock signal CL is high (CL=High) and the inversion clock signal CX is low (CX=Low), and performs a latch operation when the clock signal CL is low (CL=Low) and the inversion clock signal CX is high (CX=High). In addition, when an initial signal INIT is high, the latch circuit 74 forcedly outputs a low signal and performs resetting.

Figure 5D:
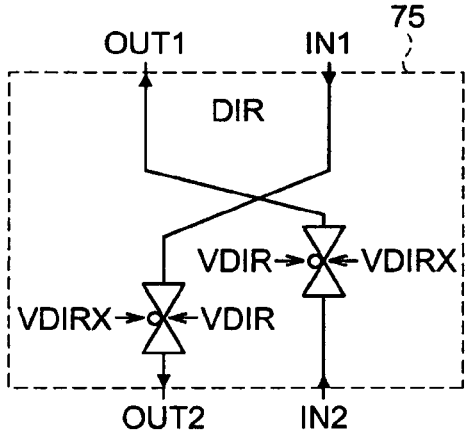

Furthermore, the bidirectional transmission circuit 75, as illustrated in FIGS. 4 and 5D, when a transmission direction control signal VDIR is high (VDIR=High) and a transmission direction inversion control signal is VDIRX is low (VDIRX=Low), forward transmission having the order of n=1→2→3. . . is performed, and, when the transmission direction control signal VDIRX is low (VDIRX=Low) and the transmission direction inversion control signal VDIRX is high (VDIRX=High), backward transmission having the order of n=480→479→478. . . is performed. Furthermore, when the bidirectional transmission is not required, the bidirectional transmission circuit 75 may be omitted.

The NAND circuit 76 receives the output signals of the front and back stages of the latch circuit 74 and an enable signal from an enable signal terminal VENB and outputs them as the output signal of the sequentially selecting circuit 71. In more detail, the output from the latch circuit 74 is input to the NAND circuit 76 and the NAND circuit 76 outputs a LOW level (=VS level) to only the stages which are selected at a timing when the enable signal VENB supplied from an enable signal terminal 31*c* is in a HIGH (=VD) state and outputs a HIGH level (=VD level) to the rest stages.

The signal having the level VD-VS is converted into a signal having a level VH-VLL by the level shifter circuit 81 and input to an n-channel type transistor 83 and a p-channel type transistor 84 of the output circuit 82.

Figure 5E:
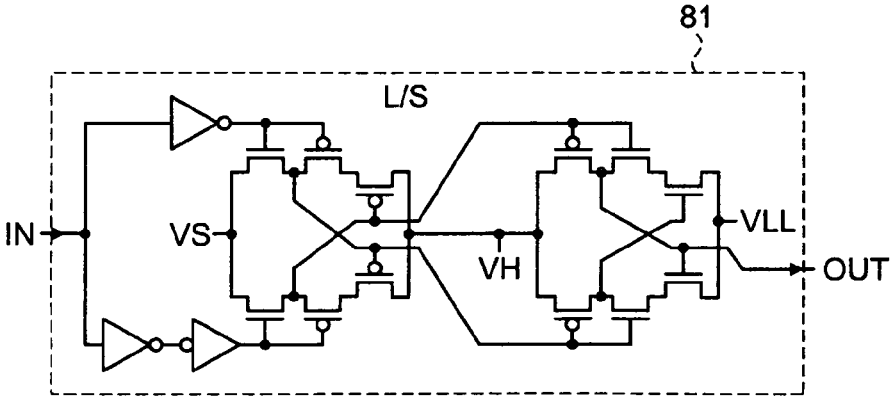

FIG. 5E illustrates a configuration of the level shifter circuit 81. By arranging two flip-flop type level shifters in series, the signal having the level VD-VS is converted into the signal having the level VH-VLL. When the output signal from the NAND circuit 76 is in the LOW (=VS) state, that is, the selected state, a potential VH is written to the scanning line 13 by the p-channel type transistor 84. Accordingly, the potential VH is supplied to the gate electrode of the transistor of the pixel switching element 43 as a selection potential and thus the pixel switching element 43 has a low electrical impedance. In addition, when the output signal from the NAND circuit 76 is in the HIGH state (=VH), a potential VLM is selected if a polarity signal POL is in a HIGH state by the n-channel type transistors 85 and 86 and a potential VLL is selected if a polarity inversion signal POLX is in a HIGH state to be written to the scanning line 13 by the n-channel type transistor 83. Accordingly, the potential VH-VLL/VLM is supplied to the gate electrode of the transistor of the pixel switching element 43 as a non-selection potential and thus the pixel switching element 43 has a high electrical impedance.

Accordingly, a signal having a potential level VH-VLL/VLM is finally applied to the scanning line 13. Here, VH=10 V, VLM=−1 V, and VLL=−5 V. In addition, in the first embodiment, although a switch is provided in each stage of the scanning-line driving circuit 21 using the polarity signal POL in switching the potential VLL and the potential VLM, the output circuit 82 may be composed of a complementary type inverter and the power supply line connected to the n-channel type transistor may be AC-driven with a level of −4.5 V to −0.5 V. In this case, the phase is identical to that of a common potential signal VCOM. Moreover, in an inversion timing, the scanning line may be in a floating state and inverted by coupling capacitance with the common electrode.

Figure 6:
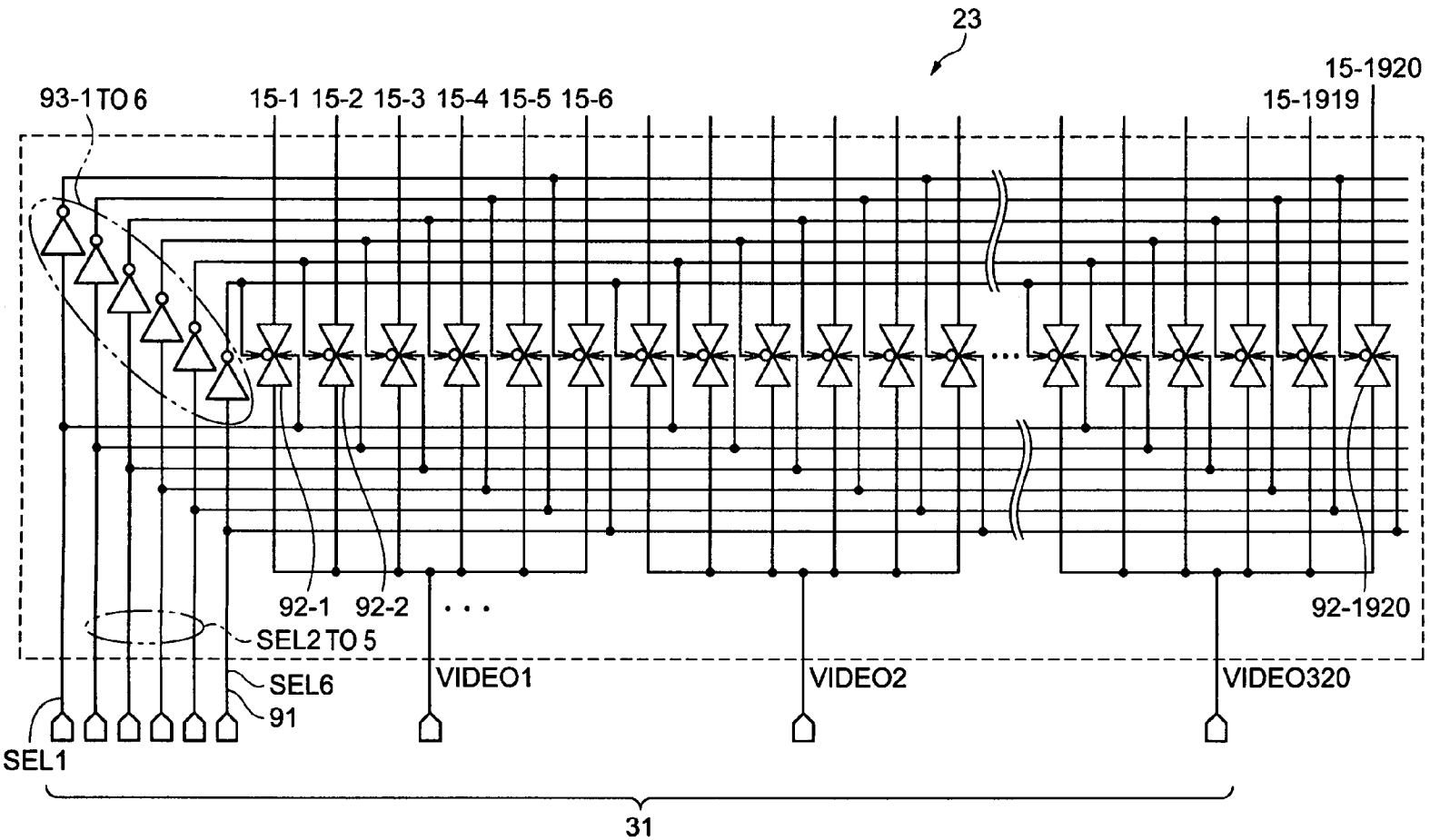
FIG. 6 is a circuit diagram of a data-line driving circuit according to the first embodiment of the invention.

FIG. 6 illustrates a configuration of the data-line driving circuit 23. Image signals VIDEO1~320 supplied from the signal input terminal 31 are connected to transmission gate switches 92 which are provided in correspondence with the number of selection signal lines 91 with respect to each block. Furthermore, the image signals VIDEO are written to the data lines 15 corresponding to the transmission gate switches 92, by the transmission gate switches 92 in each block which is selected by selection signals SEL1~6. This is a partial driver method using a 1:6 multiplexer. The selection signals SEL1~6 have the level VH-VLL. Reference numeral 93 of FIG. 6 denotes an inverter circuit for generating the reverse polarity signals of the selection signal SEL1~6. The power supply voltage has the level VH-VLL. Moreover, the image signals VIDEO have potential amplitudes of 0.5 to 4.5 V.

By this configuration, when the selection SELL is in a HIGH (=VH) state and the other selection signals SEL2~6 are in a LOW (=VLL) state, the image signal VIDEO1 and the data line 15-1 in the block is short-circuited and the other data lines 15-2~6 in the same block are insulated. Next, when the selection signal SEL2 is in a HIGH (=VH) state, the other selection signals SELL and SEL3~6 are in a LOW (=VLL)

state, the image signal VIDEO2 and the data line 15-2 are short-circuited and the other data lines 15-1 and 15-3~6 are insulated. As such, by sequentially setting the selection signals SEL1~6 in a HIGH state in one scanning-period selection period, the image signal VIDEO1 can be distributed into the data lines 15-1~6.

Figure 7:
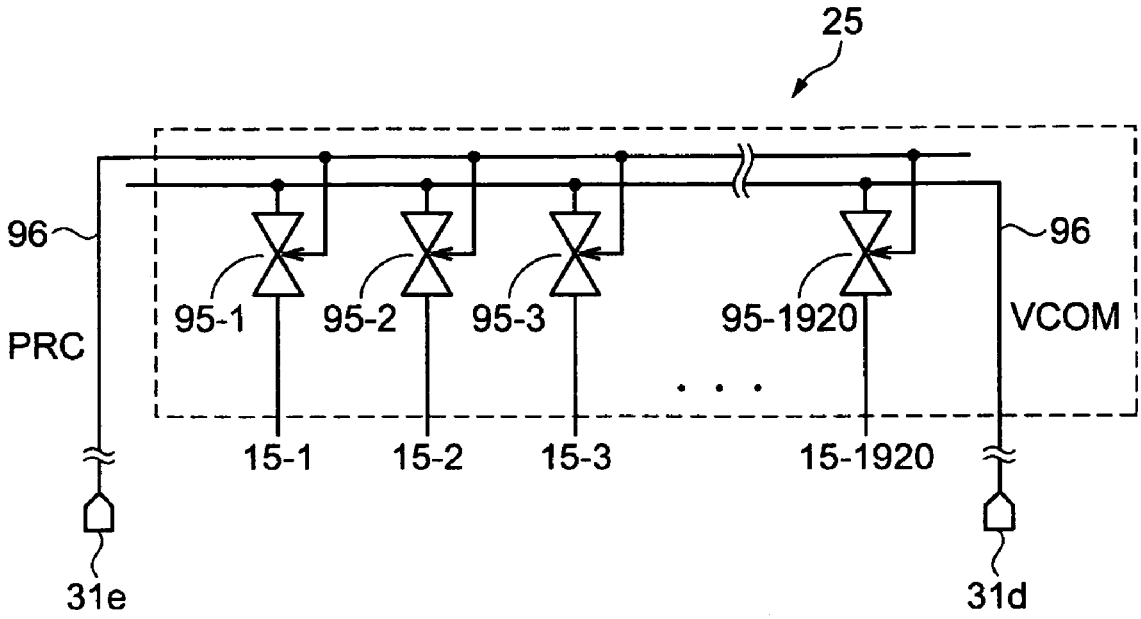
FIG. 7 is a circuit diagram of a data-line precharge circuit according to the first embodiment of the invention.

FIG. 7 illustrates a configuration of the data-line precharge circuit 25. The data lines 15 are connected to a common potential line 96, to which a common potential VCOM is supplied from the common potential terminal, through transmission gate switches 95. In addition, the gates of the transmission gate switches 95 are commonly connected with a precharge signal line 96, to which a precharge signal PRC is supplied. Moreover, the common potential signal VCOM is simultaneously written to the data lines 15 by the precharge signal PRC. Accordingly, the load at the time of the writing of the data lines is reduced and thus it is possible to surely perform the writing. Here, although the common potential VCOM is used, an adequate potential may be applied depending on writing capability. For example, in a case of an intermediate gray level potential, the potential of 2.5 V may be applied. Furthermore, if the writing time is enough, the data-line precharge circuit 25 may be omitted. Moreover, there is a method of performing the precharge through the data-line driving circuit 23 without using the data-line precharge circuit 25. That is, all the selection signals SEL1~6 may be selected at a timing of selecting the precharge signal PRC and the common potential signal VCOM or the potential corresponding thereto may be supplied to the image signals 1~320.

Here, the pixel arrangement of the liquid crystal display device of the first embodiment has a longitudinal mosaic shape. That is, in a region corresponding to the pixel electrode 45 of the opposed substrate 12, a color filter is provided in each block such that red (R), green (G), blue (B), red (R), green (G), blue (B) are repeated from the left side. Accordingly, all the color materials of the opposed substrate 12 facing the pixel electrodes 402-n-1, 4, 7, . . . , and 1918 connected to the data lines 15-1, 4, 7, . . . , and 1918 have red (R). That is, all the image signals written by a timing when the selection signals SEL1 and SEL4 are selected have red (R). Similarly, all the image signals written by a timing when the selection signals SEL2 and SEL5 are selected have green (G), and all the image signals written by a timing when the selection signals SEL3 and SEL6 are selected have blue (B).

Figure 8A:
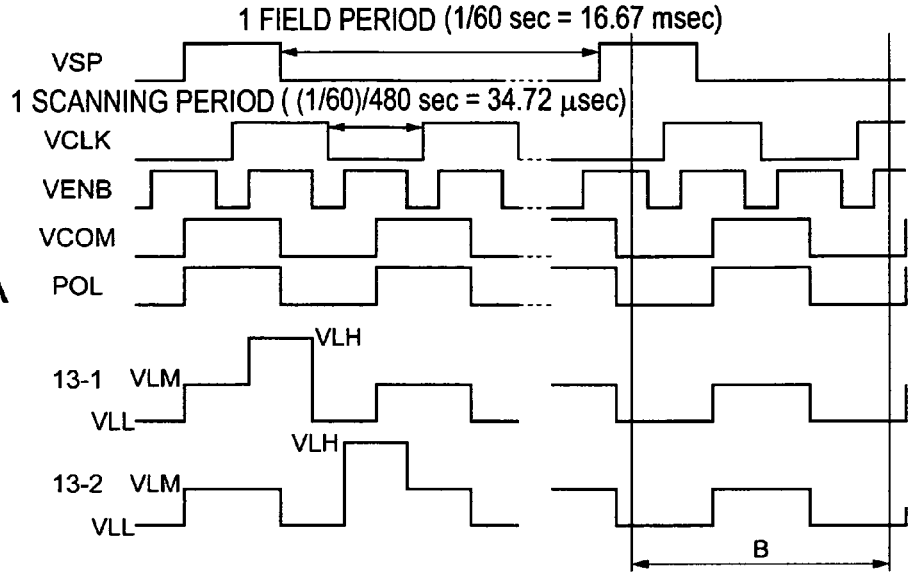
FIG. 8 is a timing chart of driving signals according to the first embodiment of the invention.

Next, FIG. 8 is a timing chart illustrating the timings of driving signals input through the signal input terminal 31. FIG. 8A is a chart illustrating the start pulse signal VSP, the clock signal VCLK and the enable signal VENB which are the control signals of the scanning-line driving circuit 21, the common potential signal VCOM input from the common potential input terminal 32, and the signals output from the scanning-line driving circuit 21 to the scanning lines 13-1 and 13-2. The start pulse signal VSP is input in one field period, that is, in a period of 16.67 msec in the first embodiment, since a refresh rate is 60 Hz. The clock signal VCLK is inverted in a scanning period, that is, a period of 34.72 μsec in the first embodiment. In addition, the enable signal VENB is a pulse wave having a scanning period and has a pulse length of 31.25 μsec. The polarity signal POL has the same period as that of the clock signal VCLK and a phase which is shifted from the clock signal VCLK by 17.36 μsec. Although not illustrated, the polarity inversion signal POLX has the same frequency and amplitude as those of the polarity signal POL and the polarity opposite to the polarity of the polarity signal POL. The start pulse signal VSP, the clock signal VCLK, the enable signal VENB have the level VS-VD and the polarity signal POL and the polarity inversion signal POLX have the level VLL-VH. In addition, the transmission direction control signal VDIR is fixed to the level VD and the transmission direction inversion control signal VDIRX and the initial signal INIT are fixed to the level VS. By inputting these signals to the scanning-line driving circuit 21, any one of the scanning lines 13-n is in a HIGH state during 31.25 μsec in each scanning period and the scanning line are sequentially selected in an interval of 34.72 μsec in the order of n=1, 2, 3, . . . (in a case of the transmission direction control signal VDIR=VD and the transmission direction inversion control signal VDIRX=VS). A non-selection period is inverted between the level VLL-VLM in synchronization with the polarity signal POL. The common potential signal VCOM is a rectangular wave having the same frequency and phase as those of the polarity signal POL, of which the low potential is 0.5 V and the high potential is 4.5 V.

Figure 8B:
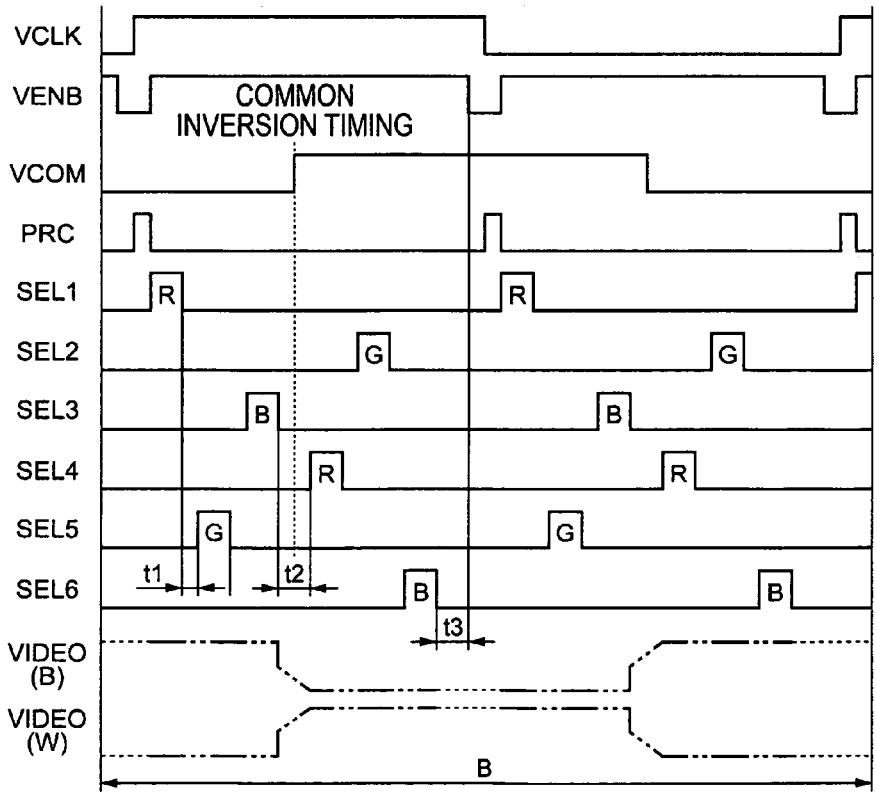

FIG. 8B is a timing chart of the selection signal SEL1~6, the precharge signal PRC, and the image signals VIDEO1~320 in the data-line driving circuit 23 during a period B of FIG. 8A. In addition, in FIG. 8B, VIDEO(W) denotes the image signal input to VIDEO1~320 at the time of whole white display (black display if the normally black mode) and VIDEO(B) denotes the-image signal input to VIDEO1~320 at the time of whole black display (white display if the normally black mode). A dotted line is not specially defined or represents a high impedance state. As such, in one scanning period, the precharge signal PRC, the selection signal SEL1, the selection signal SEL5, the selection signal SEL3, the selection signal SEL4, the selection signal SEL2, and the selection signal SEL6 are selected in this order. The order of the corresponding colors is R→G→B→R→G→B. Each of the selection periods of the selection signals SEL1~6 is 3.16 μsec. Here, the selection periods of the selection signal SEL1, the selection signal SEL5, and the selection signal SEL3 are defined as a first selection period and the selection periods of SEL4, SEL2, and SEL6 are defined as a second selection period. Between the respective selection period, there is a period that all the selection signals SEL1~6 and the precharge signal PRC are not selected. Only a non-selection period (first non-selection period) between the selection period of the selection signal SEL3 and the selection period of the selection signal SEL4 is t2=3.16 μsec and the other non-selection periods (second non-selection period) is t1=1.58 μsec. The common potential signal VCOM is inverted during the first non-selection period between the selection period of the selection signal SEL3 and the selection period of the selection signal SEL4. As such, the reason why only the non-selection period at the time of inverting the common potential signal VCOM is long is because all the data lines must be in the high impedance state from a time when the common potential signal VCOM starts to be inverted to a time when the common potential signal VCOM is enough to be relaxed. However, if t1=3.16 μsec, the width of the selection periods of the selection signals SEL1~6 becomes 2.63 μsec and thus writing may become insufficient. In addition, the selection signals SEL1~6 and the precharge signal PRC have the level VH-VLL (potential amplitude of −5~10 V) and the image signals VIDEO1-320 have the potential amplitude of 0.5 to 4.5 V.

Here, supposing that the black potential VIDEO(B) is written to the whole pixels, the potential of the each timing in the scanning period is considered. The common potential signal VCOM is initially 0.5 V. First, the precharge signal PRC is selected such that the data-line precharge circuit 25 operates, and the whole data lines 15 are written with 0.5 V. Next, the enable signal VENB is turned on and a specific scanning line 13 has a selection potential (=VH). The 479 rest scanning lines have the non-selection potential (=VLL). Here, the selection signal SELL is selected and the potential of 4.5 V is written to the data lines 15-1, 7, . . . , and 1915. Here, since the data lines 15-1, 7, . . . , and 1915 are connected to the pixel corresponding to the odd-th red display from the left side in a scanning line direction, they are hereinafter referred to as Rodd lines for the convenience sake. Similarly, the data lines 15-2, 8, . . . , and 1916 are referred to as Godd lines, the data lines 15-3, 9, . . . , and 1917 are referred to as Bodd lines, the data lines 15-4, 10, . . . , and 1918 are referred to as Reven lines, the data lines 15-5, 11, . . . , and 1919 are referred to as Geven lines, and the data lines 15-6, 11, . . . , and 1920 are referred to as Beven lines. Next, the selection signal SEL4 is selected and the Geven lines and the selection signal SEL3 are selected such that 4.5 V is written to the Bodd line. At this time, the pixel electrodes 45-n-1, 3, 5, . . . connected to the Rodd lines, the Geven lines, the Bodd lines are being written with 0.5 V to 4.5 V. Meanwhile, the Reven lines, the Godd lines, the Beven lines and the connected pixel electrodes 45-n-2, 4, and 6 have the precharge potential, that is, 0.5 V.

Next, at a common inversion timing, the common potential signal VCOM is inverted from 0.5 V to 4.5 V and the polarity signal POL and the polarity inversion signal POLX are also inverted. Thus, the non-hold potential of each of the scanning lines 13-n is inverted from VLL to VLM. After relaxation time of about 1 μsec, the common potential signal VCOM reaches a predetermined potential. However, at this time, since the transmission gate switches 92-n and 95-n connected to the whole data lines 15 are in the high impedance state, the potential rises by the capacitive coupling. If the capacitance of the data line 15 is divided into three capacitances such as an intersection capacitance C1 with the scanning line 13-n, a capacitance C2 between the intersection capacitance with the capacitive line 17-n and the opposed electrode, the other capacitance C3 such as a parasitic capacitance of the transmission gates 92-n and 95-n, GND of a module case or a parasitic capacitance with the power supply in a panel, the potential variation amount ΔV due to the capacitive coupling of the data line becomes $\Delta V=479/480*C1*(VLM-VLL)/(C1+C2+C3)+C2*(4.5-0.5)/(C1+C2+C3)$. Since VLM=−1 V and VLL=−4 V, the potential variation amount becomes $\Delta V=4*(479/480*C1+C2)/(C1+C2+C3)$. Moreover, since all the pixel electrodes 45 are in the floating state or short-circuited by the data lines 15, the capacitance with the pixel electrode 45 need not be considered. In the first embodiment, the liquid crystal display having 4 inches in a diagonal direction is used and C1 to C3 become C1=2.5 pF, C2=16.3 pF, and C3=0.08 pF from the result such as a simulation. Accordingly, ΔV is 3.98 V, the data lines of the Rodd lines, the Geven lines, the Bodd lines have 8.48 V, and the data lines of the Reven line, the Godd lines and the Beven lines have 4.48 V. In addition, since substantial 100% of the capacitances of the pixel electrodes 45 are composed of the capacitances of the capacitive lines, the opposed electrode, the scanning lines, and the data lines, the potential of 4 V varies by the capacitive coupling and the pixel electrodes 45-n-2, 4, 6, . . . have the potential of 4.5 V during the pixel electrodes 45-n-1, 3, 5, . . . have 4.5 V to 8.5 V.

Thereafter, the selection signal SEL4, the selection signal SEL2, and the selection signal SEL6 are selected in this order, and the Reven lines, the Godd lines, the Beven lines are written with the potential of 0.5 V. After the selection signal SEL6 becomes the non-selection state, the enable signal VENB is in the OFF (=VS) state, the potential of the data line 15 is finally written to the pixel electrode 45 until the scanning line 13-n has the potential VLM (t3 period=3.16 μsec of FIG. 7B), and the pixel electrodes 45-n-1, 3, and 5 have substantially 8.48 V and the pixel electrodes 45-n-2, 4, and 6 have substantially 0.5 V. Moreover, the feed-through of the pixel switching element 43 is ignored.

In a next scanning-line selection period (period that the scanning line 13-n+1 has VH), the common potential signal VCOM initially has 4.5 V and is inverted to 0.5 V. The operation at this time is fully identical to the above-described operation except that the polarity of the variation amount of the capacitive coupling is inverted, and, in the timing when the enable signal VENB is in the OFF state, the pixel electrodes 45-n+1-1, 3, 5, . . . have substantially −3.48 V and the pixel electrodes 45-n+1-2, 4, 6 . . . have substantially +4.5 V. This operation is repeated with respect to 480 scanning lines and the writing of one field period is completed.

The voltages applied to the liquid crystal elements of the pixels at this timing (=the potential of the pixel electrode−the potential of the common electrode) are illustrated in FIG. 9. Furthermore, + indicates a positive polarity having a potential higher that of the common electrode and − indicates a negative polarity having a potential lower than that of the common electrode. After one field period, the polarities of all the pixels are inverted. This is the dot inversion drive and flicker becomes invisible.

As described above, the data lines 15 have the potential amplitude of about −3.5 V to +8.5 V, and, at this time, the potentials VH and VL of the scanning-line driving circuit 21 must be set such that the pixel electrode 45 is surely written by the pixel switching element 43. If a threshold value of the transistor of the pixel switching element 43 is Vth, VH≧8.5 V+Vth. In the first embodiment, since Vth=1.0 V, VH is set to 10 V. The power supply voltages for controlling the transmission gate switch 92-n of the data-line driving switch 92-n and the transmission gate switch 95-n of the data-line precharge circuit 25 must have the potential amplitude greater than about −3.5 V to +8.5 V which is the potential amplitude of the data lines 15 in order to avoid the leakage from the data line 15, VH=10V and VLL=−5 V are set. In addition, in the first embodiment, VH and VLL of the scanning-line driving circuit 21 and VH and VLL of the data-line driving circuit 23 are identical in order to reduce the input terminal and the power supply IC, they may be different. In this case, from the above-described condition, it can be seen that VH of the scanning-line driving circuit 21 must be higher than VH of the data-line driving circuit 23.

Figure 10A:
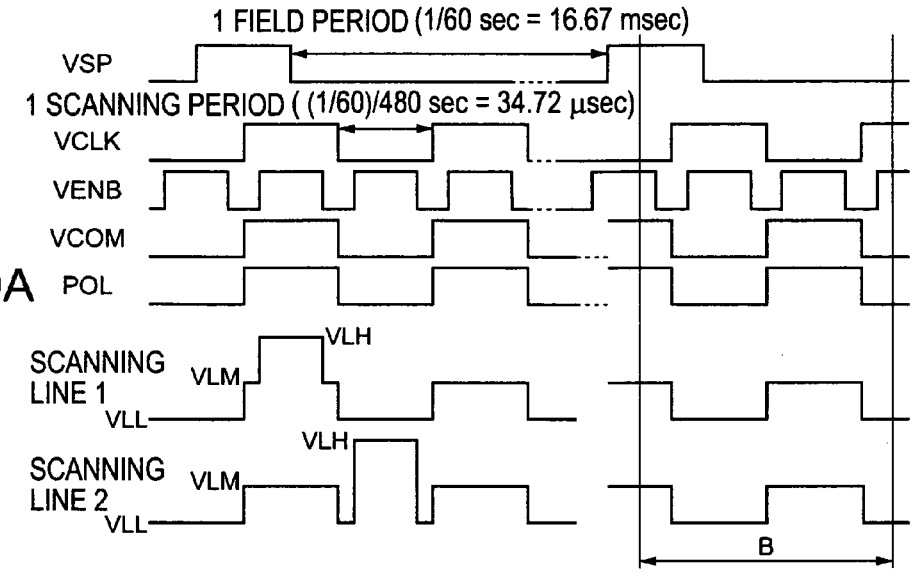
FIG. 10 is a timing chart of driving signals according to a comparative embodiment.
Figure 10B:
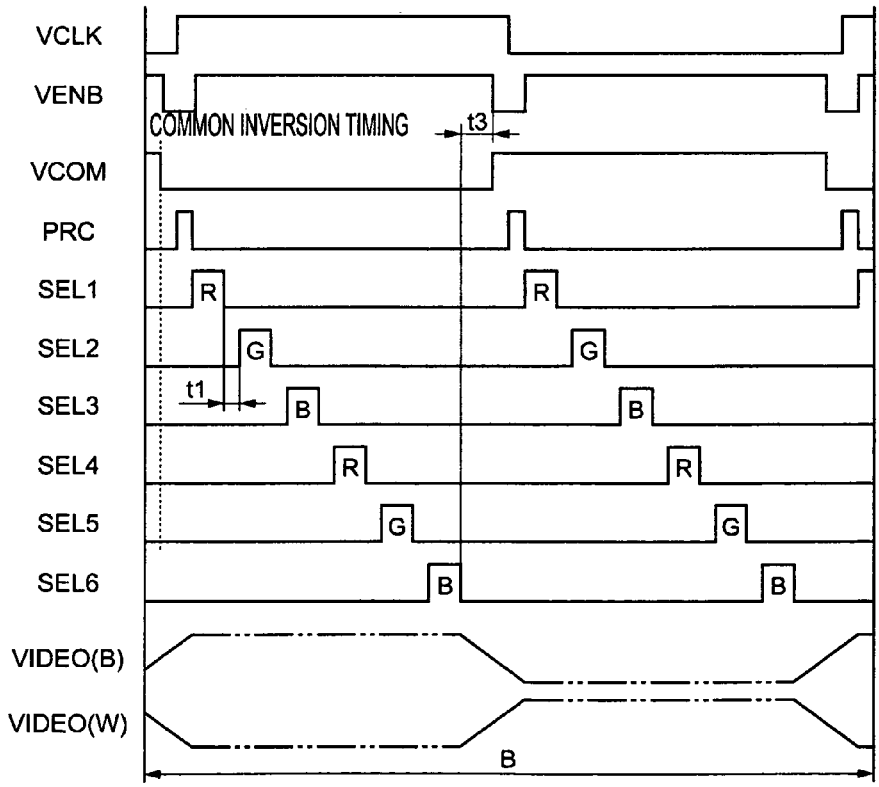

FIG. 10 is a timing chart of the control signal applied to a typical data-line driving circuit as a comparative embodiment. The common potential signal VCOM and the polarity signal POL have the same period without phase shift from the clock signal VCLK. The selection signals are sequentially supplied in the order of SEL1, SEL2, SEL3, . . . , and SEL 6. The voltages applied to the liquid crystal elements of the pixels at any timing are illustrated in FIG. 11. This is a gate inversion drive (or low inversion drive or 1H inversion drive). Since the typical common inversion timing is the timing when all the scanning lines are closed (=timing when the enable signal VENB is in the OFF state), only the gate inversion drive can be performed. Accordingly, the flicker is apt to be visible due to the leakage of the transistor of the pixel switching element or the feed-through of the pixel, the image quality is deteriorated, and it is difficult to reduce the frame frequency. However, these problems can be solved by the driving method of the first embodiment.

However, in the driving method of the first embodiment, the pixel written in the first selection period reduce the voltage due to the external capacitance of the data line 15 and the capacitance (C3+C1/480) of the selected scanning line 13. However, since this is similarly generated in the polarity, a DC bias is 0. At any pixel, there is no a difference in the transmittance of the liquid crystal between the frames and thus the reliability of the liquid crystal element is not deteriorated or the flicker is not generated. In a precise sense, a slight concentration difference is generated in the pixel pitch, but the difference in the pixel voltage is 20 mV and corresponds to only one gradation in 64-gradation display to be invisible. As such, when using the driving method of the first embodiment, C3+C1/n need be sufficiently smaller than C1+C2+C3. Here, C1 denotes the intersection capacitance with the whole scanning lines in the data line, C2 denotes the capacitance between the data line and the common electrode (common electrode of the opposed substrate), C3 denotes the other capacitance with the data line, and n is the number of the scanning lines. In more detail, if C3+C1/n is less than 0.5% of the C1+C2+C3, gradation deviation is less than 1/64 gradation to be invisible. In the realizing method, it is preferable that a switching circuit for insulating the data line from the image signal or the precharge signal by the high impedance at the common inversion time, that is, the transmission gate switches 92-n and 95-n in the first embodiment are formed on the active matrix circuit forming substrate. When the external IC has this role, the parasitic capacitance of the mounted part or the wiring is large and thus the capacitance C3 becomes larger. Accordingly, the first embodiment is efficient in the liquid crystal display device using a polysilicon TFT. Furthermore, as it is preferable that the number n of the scanning lines is large, it is suitable for the high-precision liquid crystal display device.

Furthermore, if the above-described condition is not satisfied, that is, the C3+C1/n cannot become smaller, the potential amplitude of the image signal voltage−the common voltage of the writing in the first selection period is preferably 1+2*(C3+C1/n)/(C1+C2+C3) times of the potential amplitude of the image signal voltage=the common voltage of the writing in the second selection period for performing the gradation display. In the first embodiment, at the time of the writing of the data lines of the Rodd lines, the Geven lines, Bodd lines, that is, at the time of selecting the selection signal SEL1, the selection signal SEL5, the selection signal SEL3, the black display image signal has 4.52/0.48 V, and the writing of the data lines of the Reven line, the Godd line, the Beven line, that is, at the time of selecting the selection signal SEL4, the selection signal SEL2, and the selection signal SEL6, the black display image signal has 4.50/0.50 V.

The liquid crystal display device having the above-described configuration has low flicker and high image quality. Furthermore, the flicker becomes invisible even if the frame rate is reduced. Since an electronic apparatus using this liquid crystal display device has improved image quality and is driven with lower power consumption, it is excellent in battery continuousness. The electronic apparatus herein includes a monitor, a TV, a notebook type personal computer, a personal digital assistant (PDA), a digital camera, a video camera, a portable phone, a portable photo viewer, a portable video player, a portable DVD player, and a portable audio player.

Second Embodiment

Figure 12:
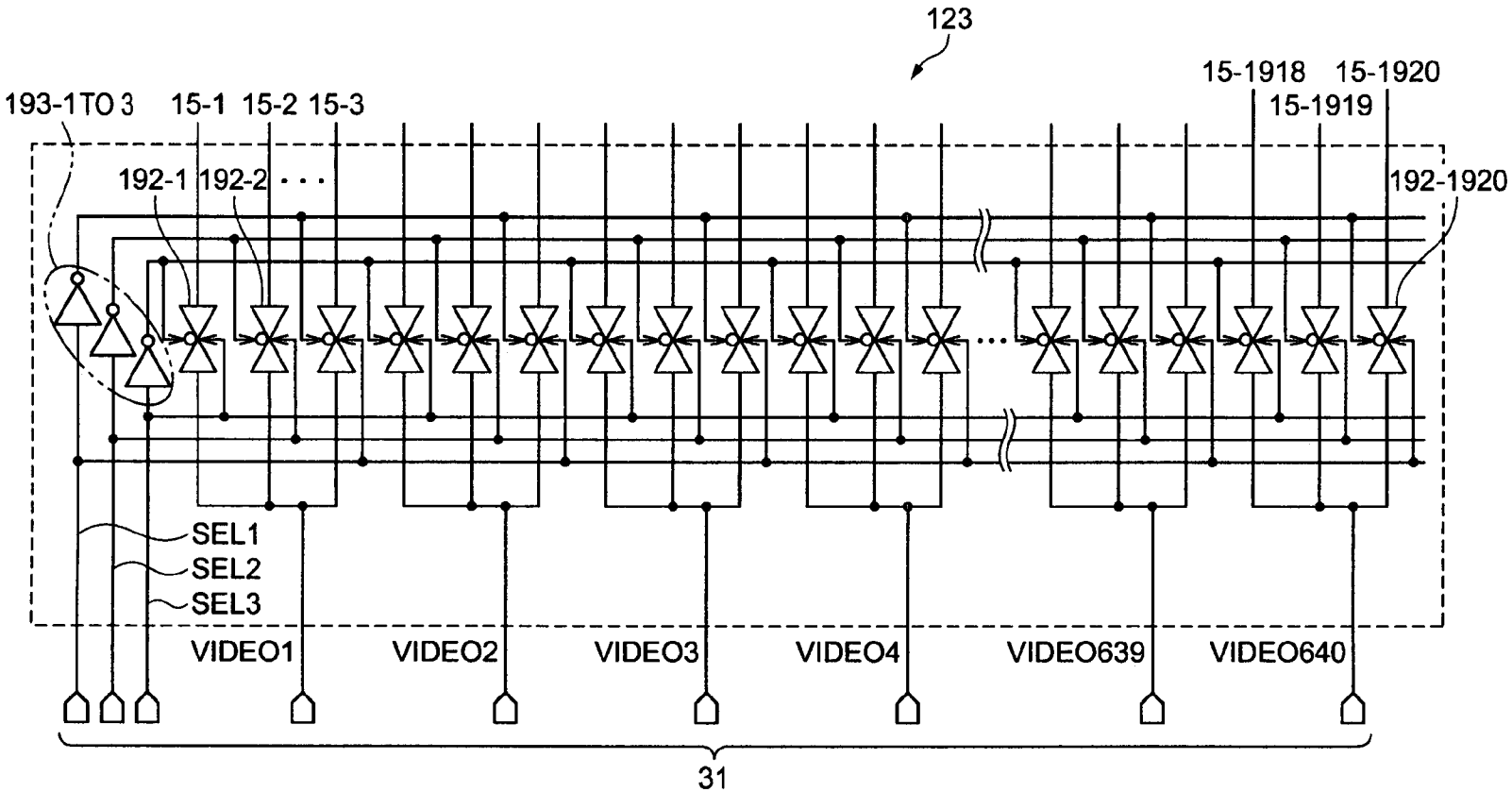
FIG. 12 is a circuit diagram of a data-line driving circuit according to a second embodiment of the invention.

FIG. 12 illustrates a configuration of the data-line driving circuit 123 according to a second embodiment. In the second embodiment, a unit block is composed of three data lines and is controlled using three selection signals SEL1~3 in accordance with the unit block. A partial driver method using 1:3 multiplexer that the image signals VIDEO1~640 supplied from the signal input terminal 31 is distributed into the transmission gate switches 192-1~1920 by the selection signals SEL1~3 and written to the data lines 15-1~1920 is used. In more detail, the image signal VIDEO1 is connected to the transmission gate switches 192-1~3 and the image signal VIDEO2 is connected to the transmission gate switches 192-4~6. The selection signal SEL1 is connected to the transmission gate switches 192-3 and 192-6, the selection signal SEL2 is connected to the transmission gate switches 192-2 and 192-5, and the selection signal SEL3 is connected to the transmission gate switches 192-1 and 192-4. Reference numerals 193-1~3 denote inverter circuits for inverting the polarity and the power supply voltage has the level VH-VLL.

The configuration of the liquid crystal display device, the configuration of the active matrix substrate, the configuration of the scanning-line driving circuit, and the configuration of the data-line precharge circuit are similar to those of the first embodiment and thus their description will be omitted.

Figure 13A:
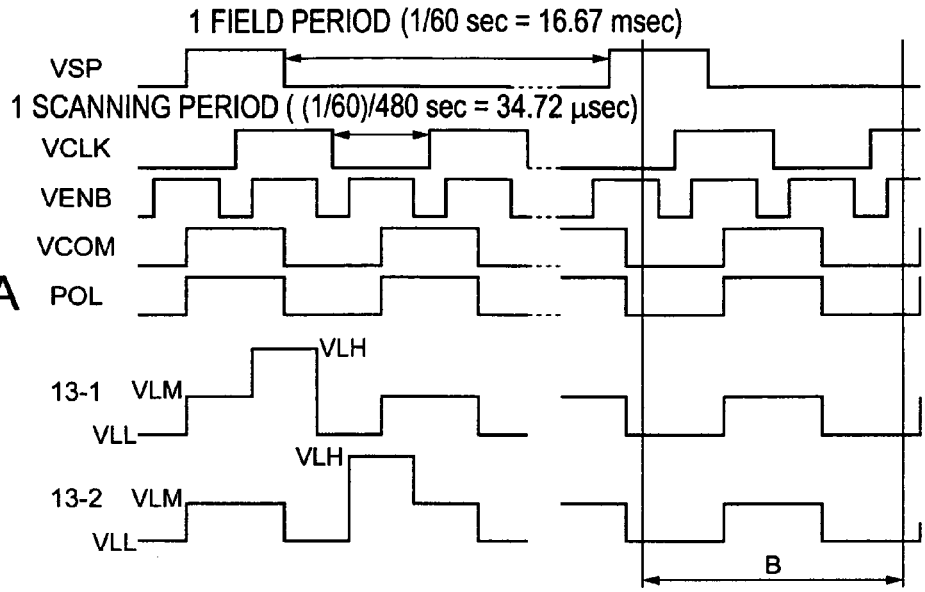
FIG. 13 is a timing chart of driving signals according to the second embodiment of the invention.

FIG. 13 is a timing chart illustrating the timings of the control signals input through the signal input terminal 31 in the second embodiment. FIG. 13A is a chart illustrating a start pulse signal VSP, a clock signal VCLK and an enable signal VENB which are the control signals of the scanning-line driving circuit 21, and a common potential signal VCOM input from the common potential input terminal 31*d*, and the signals output from the scanning-line driving circuit 21 to the scanning lines 13-1 and 13-2. The timing and operation of the signals are similar to those of the FIG. 8A and thus their description will be omitted.

Figure 13B:
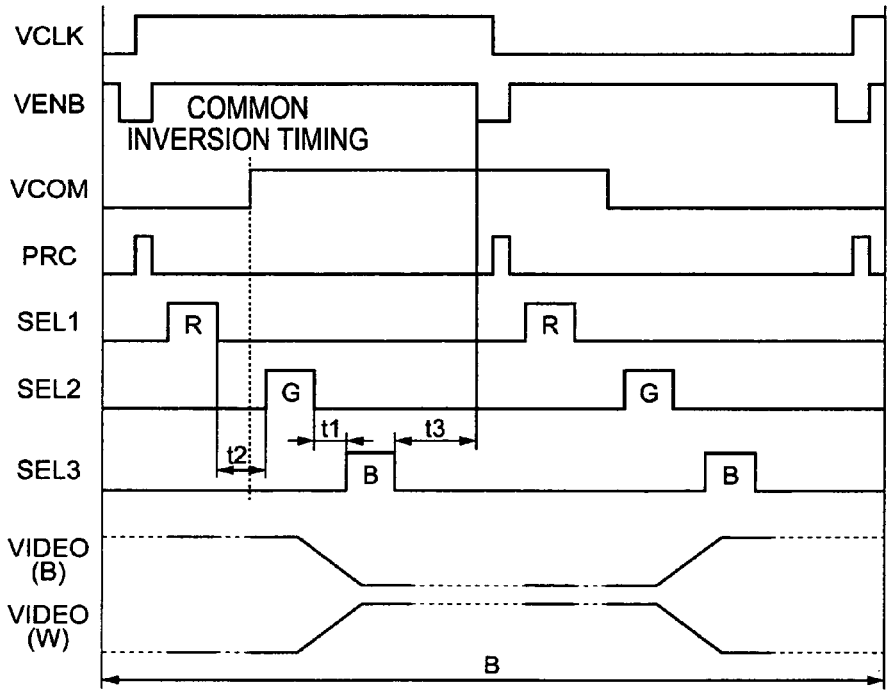

FIG. 13B is a timing chart of the selection signals SEL1~3, the precharge signal PRC, and the image signals VIDEO1~640 in the data-line driving circuit 123 during a period B of FIG. 13A. In addition, in FIG. 13B, VIDEO(W) denotes the image signal input to VIDEO1~640 at the time of whole white display (black display if the normally black mode) and VIDEO(B) denotes the image signal input to VIDEO1~640 at the time of whole black display (white display if the normally black mode). A dotted line is not specially defined or represents a high impedance state. As such, in one scanning period, the precharge signal PRC, the selection signal SEL1, the selection signal SEL2, the selection signal SEL3 are selected in this order. The order of the corresponding colors is R→G→B. Each of the selection periods of the selection signals SEL1~3 is 4.74 μsec. Here, the selection period of the selection signal SELL is defined as a first selection period and the selection periods of the selection signal SEL2 and the selection signal SEL3 are defined as a second selection period. Between the respective selection periods, there is a period that all the selection signals SEL1~3 and the precharge signal PRC are not selected. The non-selection period (first non-selection period) between the selection period of the selection signal SELL and the selection period of the selection signal SEL2 is t2=6.32 μsec and the non-selection periods (second non-selection period) between the selection period of the selection signal SEL2 and the selection period of the selection signal SEL3 is t1=3.16 μm. The common potential signal VCOM is inverted during the non-selection period between the selection period of the selection signal SEL1 and the selection period of the selection signal SEL2. The reason of t2>t1 is similar to that of the first embodiment.

In the input signal level, the clock signal VCLK, the start pulse signal VSP, the enable signal VENB have the level VD-VS (potential amplitude of 0~8 V), the selection signals SEL1~3, the precharge signal PRC, the polarity signal POL, and the polarity inversion signal POLX have the level VH-VLL (potential amplitude of −5~10 V), and the image signals VIDEO1~640 and the common potential signal VCOM have the potential amplitude of 0.5 to 4.5 V.

Figure 14:
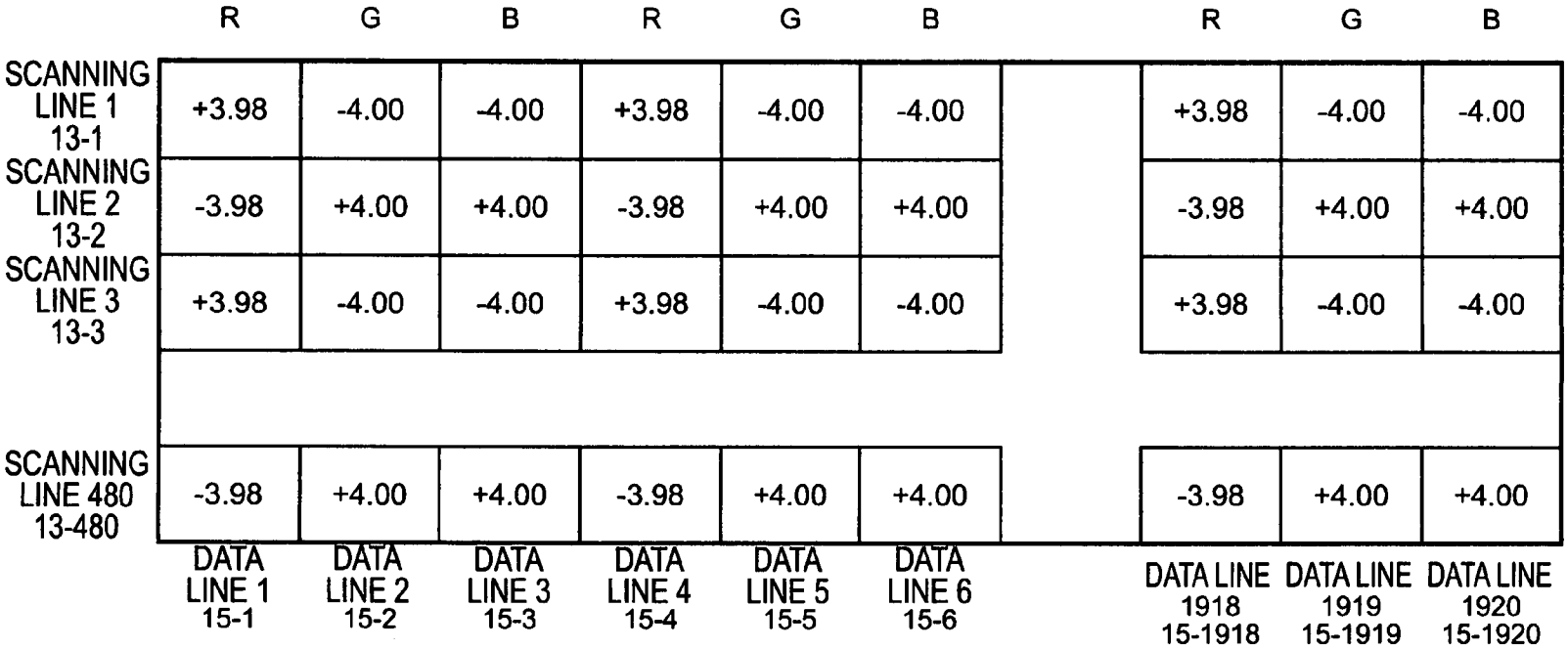
FIG. 14 illustrates voltage applied to the liquid crystal elements of the pixels according to the second embodiment of the invention.

When the driving is performed at this timing, the voltages applied to the liquid crystal elements of the pixels at any timing (=the potential of the pixel electrode−the potential of the common electrode) are illustrated in FIG. 14. Furthermore, + indicates a positive polarity having a potential higher that of the common electrode and − indicates a negative polarity having a potential lower than that of the common electrode. After one field period, all the pixels are inverted. Although the complete dot inversion is not performed as illustrated in FIG. 9 of the first embodiment, since the pixels having different polarities are mixed on the same scanning line, the flicker becomes more invisible compared with the gate inversion drive illustrated in FIG. 11.

Furthermore, in the second embodiment, the common inversion is performed between the selection period of the selection signal SEL1 and the selection period of the selection signal SEL2. This is because, when the polarities of the red pixel and the green pixel which are relatively sensitive to a human's eye are opposite to each other, the flicker becomes more invisible, compared with a case where the polarities of the red pixel and the green pixel are equal to each other by performing the common inversion between the selection period of the selection signal SEL2 and the selection period of the selection signal SEL3.

Figure 15:
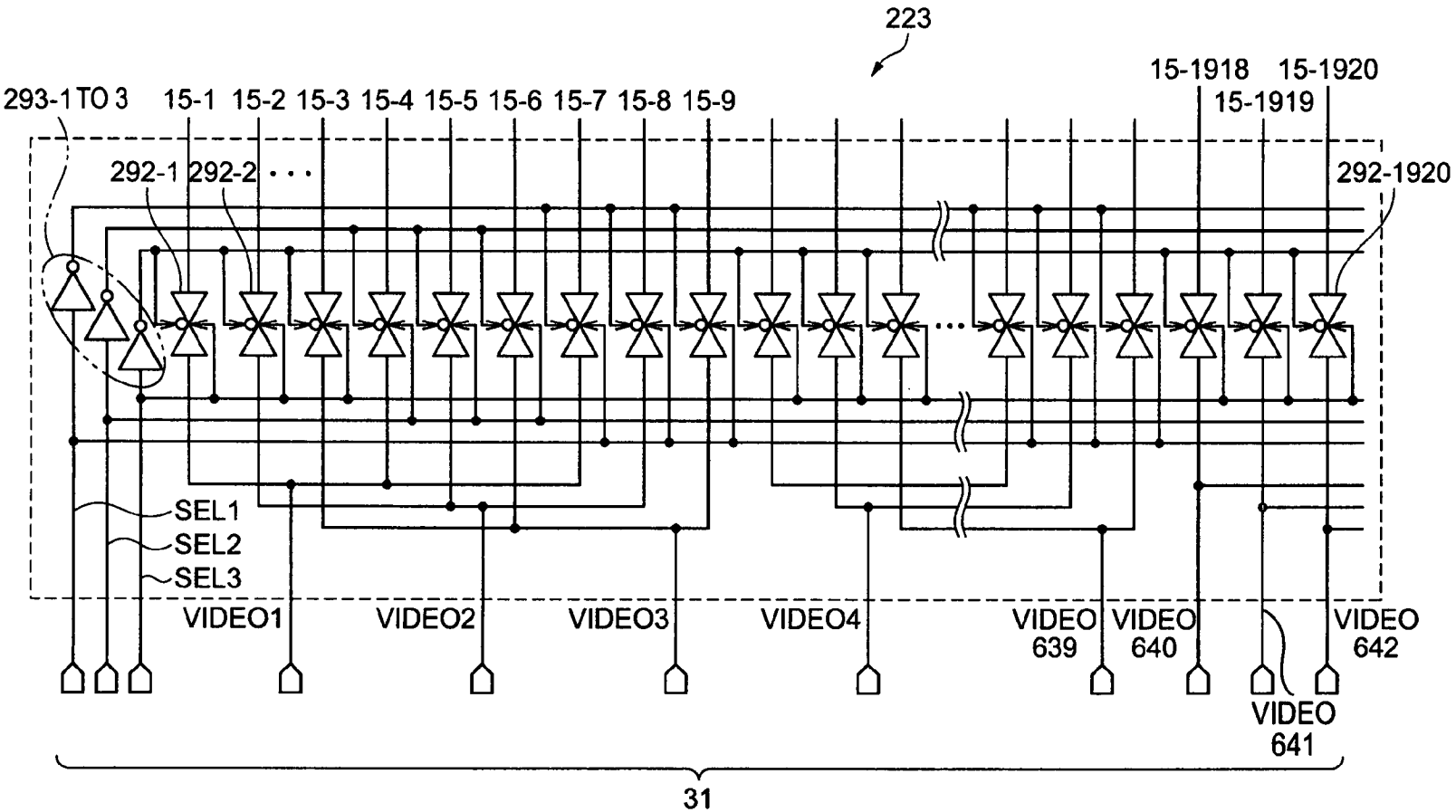
FIG. 15 is a timing chart of driving signals according to a modified example of the second embodiment.

Similarly, even in the 1:3 multiplexer, the data-line driving circuit may be configured as the modified example of FIG. 15 and the signals illustrated in FIG. 13 may be input. That is, the image signal VIDEO1 of the data-line driving circuit 223 is connected to the transmission gate switches 292-1, 292-4, and 292-7, the image signal VIDEO2 is connected to the transmission gate switches 292-2, 292-5, and 292-8, and the image signal VIDEO3 is connected to the transmission gate switches 292-3, 292-6, and 292-9. As such, the image signals VIDEO are connected to the transmission gate switches 292 as the unit block. In addition, the selection signal SEL1 is connected to the transmission gate switches 292-7~9, the selection signal SEL2 is connected to the transmission gate switches 292-4~6, the selection signal SEL3 is connected to the transmission gate switches 292-1~3 as the unit block. Reference numerals 293-1~3 denote inverter circuits for inverting the polarity and the power supply voltage has level VH-VLL. By this configuration, the voltages applied to the liquid crystal elements of the pixels at any timing (=the potential of the pixel electrode−the potential of the common electrode) is illustrated in FIG. 16. This is not the dot inversion drive. However, since the polarities of the respective color pixels on the same scanning line are inverted, the flicker becomes more invisible at the level close to the dot inversion drive.

Here, 1:2 drive or 1:4 drive may be used. Even in any case, it is possible to realize inversion drive by which the flicker becomes more invisible compared with the gate inversion drive.

Third Embodiment

Figure 17:
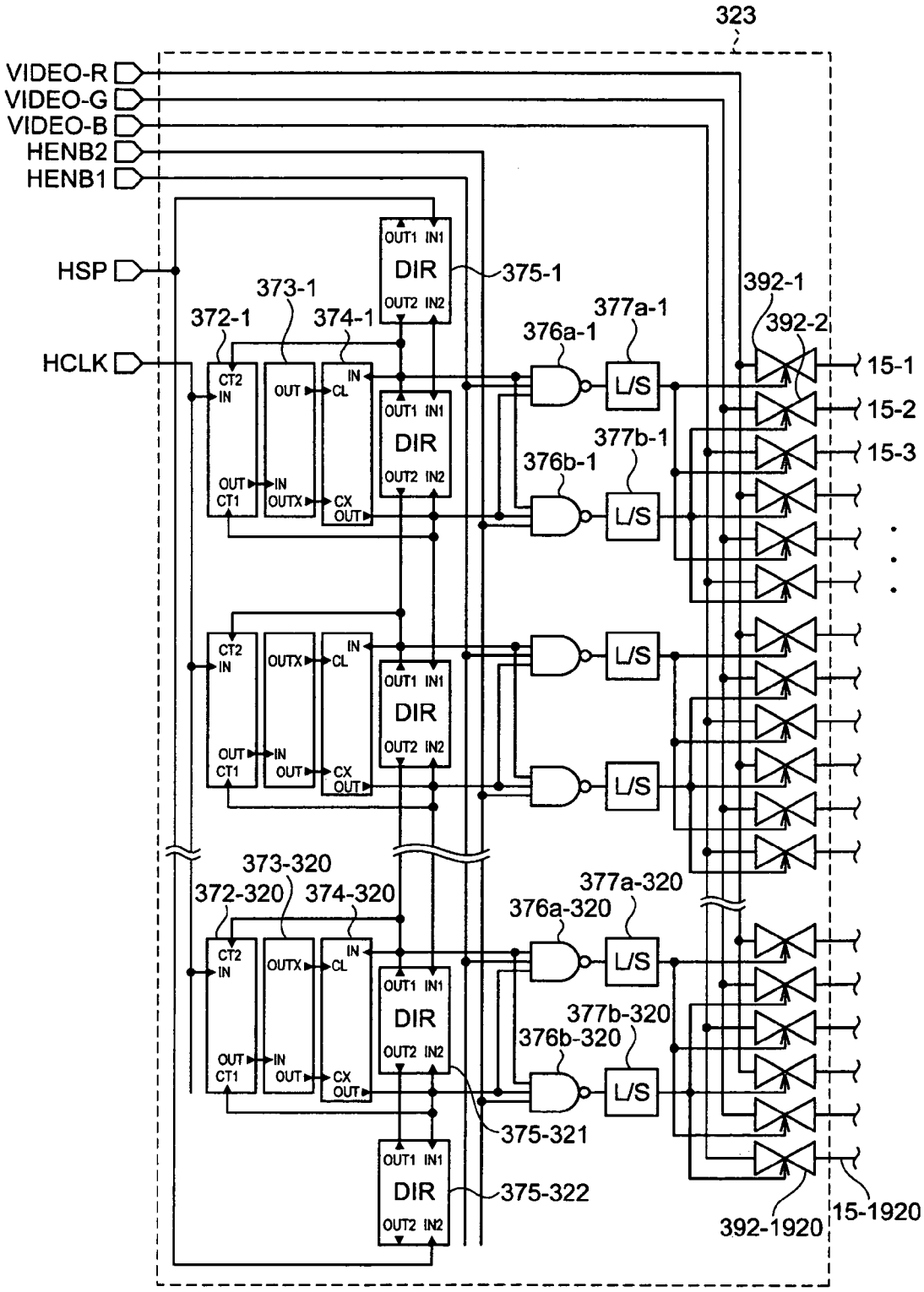
FIG. 17 is a circuit diagram of a data-line driving circuit according to a third embodiment of the invention.

FIG. 17 illustrates a configuration of a data-line driving circuit 323 according to a third embodiment. An analog dot sequential type data-line driving circuit is used. A sequential selection circuit using a bidirectional shift register includes a clock control circuit (CCC) 372, a clock generating circuit 373, a latch circuit 374, and a bidirectional transmission circuit 375. This sequential selection circuit is similar to the scanning-line driving circuit described in the first embodiment and the concrete configurations of the circuits are identical to those illustrated in FIGS. 5A to 5D.

Here, a pair of NAND circuits 376*a* and 376*b* is arranged in each stage, the NAND circuit 376*a* is supplied with an enable signal HENB1, and the NAND circuit 376*b* is supplied with an enable signal HENB 2. A pair of level shifter circuits 377*a* and 377*b* is arranged in correspondence with the NAND circuits 376*a* and 376*b*. This operation is equal to that of the first embodiment and thus its description will be omitted. The concrete circuit configuration of the level shifter circuits 377*a* and 377*b* are similar to those illustrated in the FIG. 5E.

The level shifter circuit 377*a* is connected to the transmission gate switches 392-1, 392-3, and 392-5 corresponding to the data lines 15-1, 15-3, and 15-5. In addition, the level shifter circuit 377*b* is connected to the transmission gate switches 392-2, 392-4, and 392-6 corresponding to the data lines 15-2, 15-4, and 15-6. Moreover, a red image signal VIDEO-R is connected to the transmission gate switches 392-1 and 392-4, a green image signal VIDEO-G is connected to the transmission gate switches 392-2 and 392-5, a blue image signal VIDEO-B is connected to the transmission gate switches 392-3 and 392-6. Six data lines are sequentially connected as a unit block.

By this configuration, for example, when a latch circuit 374-1 is selected, if the enable signal HENB1 is high, the transmission gate switches 392-1, 392-3, and 392-5 are turned on through the NAND circuit 376*a*-1 and the level shifter circuit 377*a*-1. In addition, among odd-th data lines, the data line 15-1 is supplied with the red image signal VIDEO-R, the data line 15-3 is supplied with the blue image signal VIDEO-B, and the data line 15-5 is supplied with the green image signal VIDEO-G. Furthermore, when the latch circuit 374-1 is selected, if the enable signal HENB2 is high, the transmission gate switches 392-2, 392-4, and 392-6 are turned on through the NAND circuit 376*b*-1 and the level shifter circuit 377*b*-1. In addition, among even-th data lines, the data line 15-2 is supplied with the green image signal VIDEO-G, the data line 15-4 is supplied with the red image signal VIDEO-R, and the data line 15-6 is supplied with the blue image signal VIDEO-B.

The configuration of the liquid crystal display device, the configuration of the active matrix substrate, the configuration of the scanning-line driving circuit, and the configuration of the data-line precharge circuit are similar to those of the first embodiment and thus their description will be omitted.

Figure 18A:
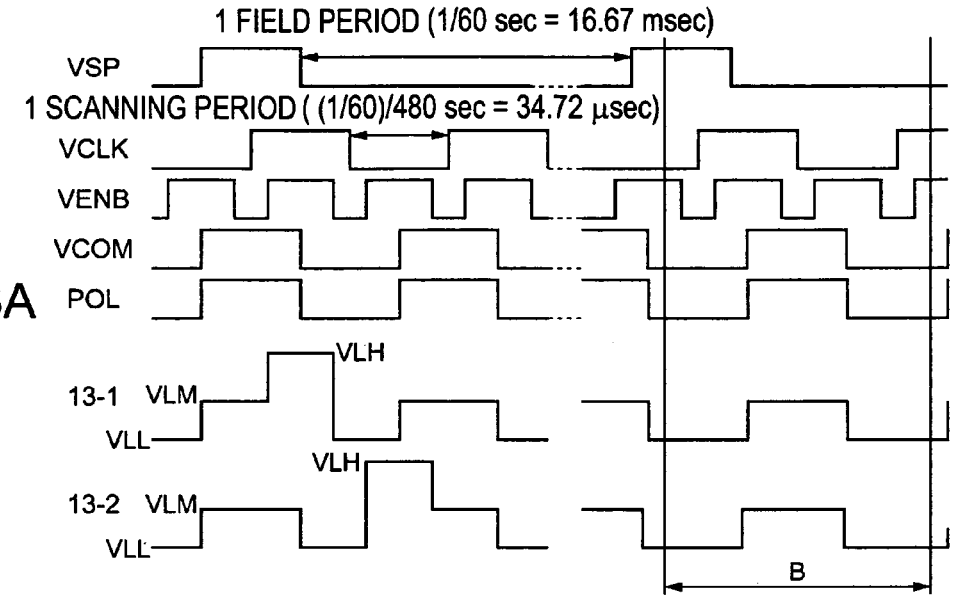
FIG. 18 is a timing chart of driving signals according to the third embodiment of the invention.

FIG. 18 is a timing chart illustrating the timings of the control signals input through the signal input terminal 31 in the third embodiment. FIG. 18A is a chart illustrating a start pulse signal VSP, a clock signal VCLK and an enable signal VENB which are the control signals of the scanning-line driving circuit 21, and a common potential signal VCOM input from the common potential input terminal 31*d*, and the signals output from the scanning-line driving circuit 21 to the scanning lines 13-1 and 13-2. The timing and operation of the signals are similar to those of the FIG. 8A and thus their description will be omitted.

Figure 18B:
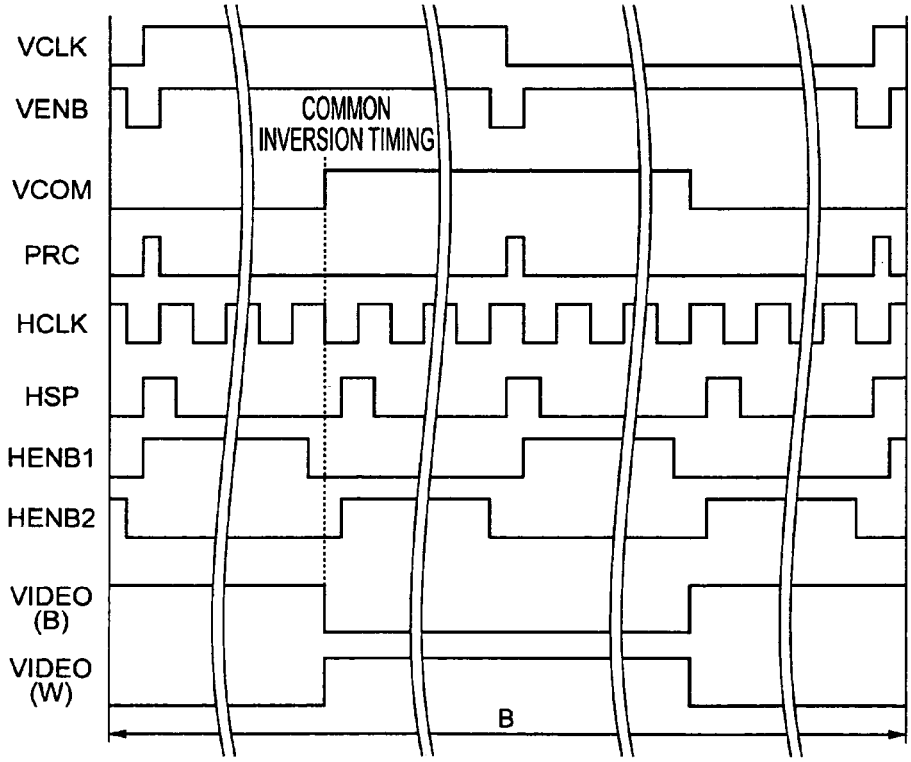

FIG. 18B is a timing chart of a clock signal HCLK, a start pulse signal HSP, an enable signal HENB1, an enable signal HENB2, the precharge signal PRC, the red image signal VIDEO-R, the green image signal VIDEO-G, and the blue image signal VIDEO-B in the data-line driving circuit 323 during a period B of FIG. 18A. In addition, in FIG. 18B, VIDEO(W) denotes the image signal input to VIDEO-R/G/B at the time of whole white display (black display if the normally black mode) and VIDEO(B) denotes the image signal input to VIDEO-R/G/B at the time of whole black display (white display if the normally black mode). In addition, the clock signal HCLK, the start pulse signal HSP, the enable signal HENB1, the enable signal HENB2, and the precharge signal PRC have level VH-VLL (potential amplitude of −5 V~10 V), and the image signals VIDEO-R/G/B and the common potential signal VCOM have the potential amplitude of 0.5 to 4.5 V.

The clock signal HCLK is a rectangular clock signal which is inverted every 48 nanoseconds and the start pulse signal HSP is a pulse wave having a period (=17.36 μsec) which is a half of the scanning-line selection period and a pulse width of 54.25 nanoseconds. The enable signal HENB1 and the enable signal HENB2 are rectangular waves (period of 34.7 μsec) having a frequency which is two times of that of the clock signal VCLK and the polarities which are opposite to each other. However, both the enable signal HENB1 and the enable signal HENB2 are turned off in the period that the enable signal VENB is turned off and at about 2 μsec before and after the inversion timing of the common potential signal VCOM, and have the pulse length of High of 15.36 μsec.

That is, in one scanning-line selection period, each stage of the sequential selection circuit which is the shift register of the scanning-line driving circuit 21 is selected two times and the polarity of the image signal is inverted in a first selection period and a second selection period. In the first selection period, the enable signal HENB1 is in the ON state and the odd-th data lines 15-1, 3, . . . and 15-1919 are selected. In the second selection period, the enable signal HENB2 is in the ON state and the even-th data lines 15-2, 4, . . . , and 15-1920 are selected. Accordingly, the period that both the enable signal HENB1, the enable signal HENB2 are in the OFF state at an inversion timing of the common potential signal in the scanning-line selection period corresponds to the first selection period. Furthermore, the switching circuit described in claims corresponding to the transmission gates 392-1~1920 in the third embodiment and the switching circuit is preferably formed on the active matrix substrate as described in the first embodiment.

If this driving is performed, the voltages applied to the liquid crystal elements of the pixels at any timing (=the potential of the pixel electrode−the potential of the common electrode) are illustrated in FIG. 9. Here, + indicates a positive polarity having a potential higher that of the common electrode and − indicates a negative polarity having a potential lower than that of the common electrode. After one field period, the polarities of all the pixels are inverted. This is the dot inversion drive and the flicker becomes more invisible compared with the gate inversion drive.

As such, the invention is realized in a dot sequential driving method as well as the multiplexer method. Similarly, for example, even in a case where a data-line driving circuit which has a DAC (digital/analog converter) and is digitally driven is mounted, the writing timing from the DAC to the data line may be divided into at least two blocks and the polarities of the blocks may be inverted. Even in any case, if the driving circuit is formed on the active matrix substrate, not on the externally attached IC, the capacitance C3 becomes smaller as described in the first embodiment. By setting the potential amplitude of the writing image signal in the first selection period larger than that of the writing image signal in the second selection period, it is possible to perform the correction.

Electronic Apparatus

Hereinafter, an electronic apparatus according to an embodiment of the invention will be described. In addition, this embodiment is an example of the invention and the invention is not limited to this embodiment.

Figure 19:
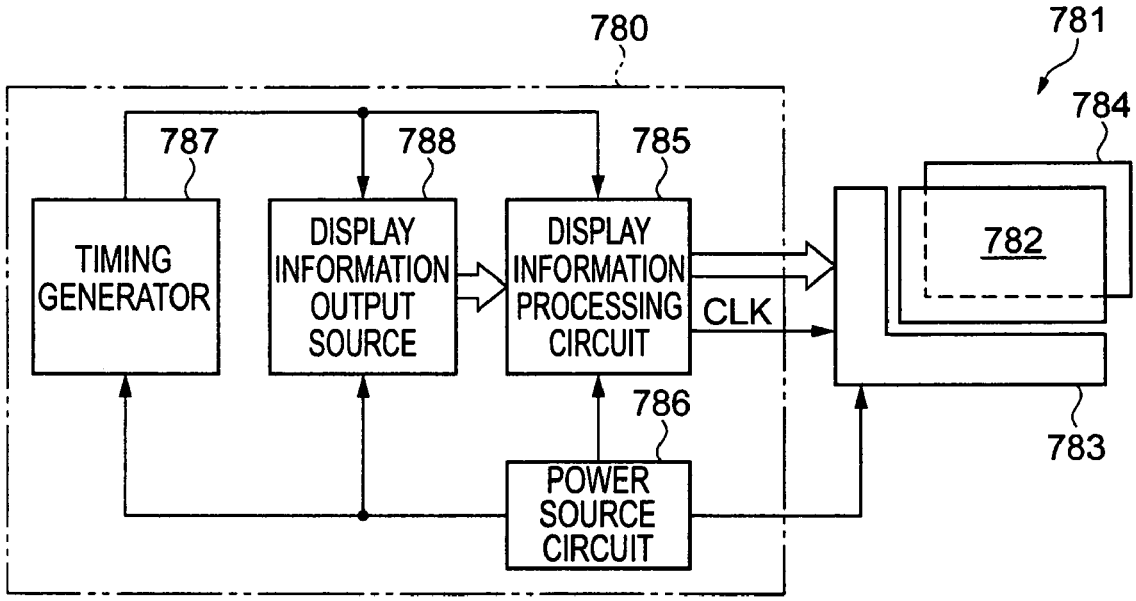
FIG. 19 is a block diagram illustrating an electronic apparatus according to an embodiment of the invention.

FIG. 19 is a block diagram illustrating an electronic apparatus according to an embodiment of the invention. The electronic apparatus illustrated herein includes a liquid crystal display device 781 and a control circuit 780 for controlling the liquid crystal display device 781. The control circuit 780 is composed of a display information processing circuit 785, a power supply circuit 786, a timing generator 787, and a display information output source 788. Furthermore, the liquid crystal display device 781 has a liquid crystal panel 782, an illumination device 784, and a driving circuit 783.

The display information output source 788 includes a memory such as random access memory (RAM), a storage unit such as various disks, or a resonance circuit for tuning and outputting a digital image signal, and supplies display information such as an image signal of a predetermined format based on the various clock signals generated by the timing generator 787.

Next, the display information processing circuit 785 includes a plurality of circuits such as an amplifying/inverting circuit, a rotation circuit, a gamma correcting circuit, a clamp circuit, and processes input display information and supplies the image signal together with the clock signal CLK to the driving circuit 783. Here, the driving circuit 783 includes the scanning-line driving circuit, the data-line driving circuit, and a testing circuit. Furthermore, the power supply circuit 786 supplies to a predetermined power supply voltage to the components.

INDUSTRIAL APPLICABILITY

The invention is not limited to the above-described embodiments and may be used in a liquid crystal display device of a vertical alignment mode (VA mode) using liquid crystal having negative permittivity anisotrophy and an IPS mode using a horizontal field, instead of the TN mode. In addition, instead of the transmissive type, the reflective type or a combination of the reflective type and the transmissive type may be used. Moreover, the active element may be an amorphous silicon TFT instead of the polysilicon TFT and the other active element may be used.

The entire disclosure of Japanese Patent Application No. 2005-100085, filed Mar. 30, 2005, is expressly incorporated by reference herein.

What is claimed is:

1. A method of driving a liquid crystal display device comprising a plurality of scanning lines, a plurality of data lines arranged to intersect the plurality of scanning lines, a plurality of pixel electrodes arranged in correspondence with the intersections between the plurality of scanning lines and the plurality of data lines, a plurality of pixel switching elements for supplying the signals of the data lines to the pixel electrodes based on the signals of the scanning lines, and an opposed electrode facing the pixel electrodes, the method comprising:

individually applying voltage to the plurality of scanning lines at separate timings to apply a selection potential and a non-selection potential to the pixel switching elements;

inversion driving the opposed electrode between a first potential and a second potential; and setting at least one of the plurality of scanning lines to the selection potential at a common inversion timing when the opposed electrode is inverted from the first potential to the second potential, a scanning-line selection period that one of the plurality of scanning lines has the selection potential having a first selection period that an image signal is written to a first data line of the plurality of data lines, a second selection period that the image signal is written to a second data line of the plurality of data lines, a first non-selection period that the image signal is not written to all the plurality of data lines, and a second non-selection period that the image signal is not written to all the plurality of data lines, the common inversion period is in the first non-selection period, the first selection period is before the first non-selection period, the second selection period is after the first non-selection period, and the length of the first non-selection period is longer than that of the second non-selection period.

2. The method according to claim 1, at the common inversion timing, the data lines being in a high electrical impedance state with a signal terminal for supplying an image signal or a precharge signal and being in a floating state except where located between the data lines and the pixel electrodes.

3. The method according to claim 1, the non-selection potential supplied to the scanning lines being inversion-driven between a third potential and a fourth potential, a scanning-line inversion timing when the non-selection potential of the scanning lines is inversion-driven from the third potential to the fourth potential is substantially identical to the common inversion timing, and a difference between the third potential and the fourth potential is substantially identical to a difference between the first potential and the second potential.

4. The method according to claim 1, the scanning lines being in a high electrical impedance state with a power supply line for supplying the selection potential and a power supply line for supplying the non-selection potential in the common inversion timing.

5. The method according to claim 1, a potential amplitude of the image signal written to the data lines in the first selection period being greater than that of the image signal written to the data lines in the second selection period.

6. A liquid crystal display device using the method according to claim 1.

7. An electronic apparatus using the liquid crystal display device according to claim 6.

8. A liquid crystal display device comprising:

a plurality of scanning lines;

a plurality of data lines arranged to intersect the plurality of scanning lines;

a plurality of pixel electrodes arranged in correspondence with the intersections between the plurality of scanning lines and the plurality of data lines;

a plurality of pixel switching elements which supply the signals of the data lines to the pixel electrodes based on the signals of the scanning lines;

an opposed electrode which faces the pixel electrodes and is supplied with a common potential which is inverted between a first potential and a second potential; and a scanning-line driving circuit which supplies the plurality of scanning lines with respective timings to apply any one of a selection potential and a non-selection potential to the pixel switching elements, and makes at least one of the plurality of scanning lines have the selection potential, at a common inversion timing when the opposed electrode is inverted from the first potential to the second potential, a scanning-line selection period that one of the plurality of scanning lines has the selection potential having a first selection period that an image signal is written to a first data line of the plurality of data lines, a second selection period that the image signal is written to a second data line of the plurality of data lines, a first non-selection period that the image signal is not written to all the plurality of data lines, and a second non-selection period that the image signal is not written to all the plurality of data lines, the common inversion period is in the first non-selection period, the first selection period is before the first non-selection period, the second selection period is after the first non-selection period, and the length of the first non-selection period is longer than that of the second non-selection period.

9. The liquid crystal display device according to claim 8, when the number of the scanning lines is n, a capacitance between the data line and the scanning line being C1, a capacitance between the data line and the opposed electrode being C2, and a capacitance between the data line and the pixel electrode and a capacitance with the data line except the capacitances C1 and C2 is C3, $(C1/n+C3)/(C1+C2+C3) \leqq 0.005$ being satisfied.

10. The liquid crystal display device according to claim 8, when an amplitude of the image signal written to the data line in the first selection period is $\Delta V1$ and the amplitude of the image signal written to the data line in the second selection period is $\Delta V2$, $\Delta V1$ being substantially identical to $\Delta V2*\{1+2*(C1/n+C3)/(C1+C2+C3)\}$.

11. The liquid crystal display device according to claim 8, a first pixel electrode of the plurality of pixel electrodes connected to the first data line and a second pixel electrode of the plurality of pixel electrodes connected to the second data line being connected to the same scanning line, and being pixels corresponding to the same color display.

12. The liquid crystal display device according to claim 11, the first pixel electrode and the second pixel electrode being closest to each other in the pixels corresponding to the same color display and being connected to the same scanning line.

13. The liquid crystal display device according to claim 8, a data-line driving circuit being formed on the same substrate as that of an active matrix circuit.

* * * * *